US008708250B2

(12) United States Patent
Yamashita et al.

(10) Patent No.: US 8,708,250 B2
(45) **Date of Patent: *Apr. 29, 2014**

(54) FUEL INJECTION DEVICE

(75) Inventors: Tsukasa Yamashita, Kariya (JP); Naofumi Adachi, Takahama (JP)

(73) Assignee: Denso Corporation, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/343,126

(22) Filed: Jan. 4, 2012

(65) Prior Publication Data

US 2012/0175435 A1 Jul. 12, 2012

(30) Foreign Application Priority Data

Jan. 7, 2011 (JP) ..... 2011-2319
Aug. 6, 2011 (JP) ..... 2011-172454

(51) Int. Cl.
*F02M 41/16* (2006.01)

(52) U.S. Cl.
USPC ..... 239/96; 239/88; 239/124; 239/533.2; 239/585.1; 123/445; 123/467; 251/129.15

(58) Field of Classification Search
USPC ..... 239/88, 124, 533.2, 96, 585.1; 123/457, 123/467, 514, 518; 251/129.15
See application file for complete search history.

(56) References Cited

U.S. PATENT DOCUMENTS

| | | | | |
|---|---|---|---|---|
| 4,826,080 | A | 5/1989 | Ganser | |
| 6,092,737 | A * | 7/2000 | Bosch et al. | 239/96 |
| 6,892,955 | B2 * | 5/2005 | Grabandt | 239/88 |
| 2003/0052198 | A1 | 3/2003 | Tappolet et al. | |
| 2009/0065614 | A1 | 3/2009 | Ganser | |
| 2010/0301143 | A1 | 12/2010 | Adachi et al. | |

FOREIGN PATENT DOCUMENTS

| | | | |
|---|---|---|---|
| EP | 1 656 498 | | 5/2006 |
| JP | 2001-065428 | | 3/2001 |
| JP | 2008-175155 | | 7/2008 |
| WO | WO 2005/019637 | * | 3/2005 |

OTHER PUBLICATIONS

Office Action (2 pages) dated Feb. 5, 2013 issued in corresponding Japanese Application No. 2011-172454 and English translation (3 pages).

Chinese Office Action issued for Chinese Patent Application No. 201210012193.3 dated Dec. 26, 2013 (with partial English translation).

* cited by examiner

*Primary Examiner* — Dinh Q Nguyen
(74) *Attorney, Agent, or Firm* — Nixon & Vanderhye P.C.

(57) ABSTRACT

A fuel injection device includes a cylinder that defines a pressure chamber at an end portion of a nozzle needle. A floating plate as a control member is placed in the cylinder. A cutout portion and multiple grooves are formed in the floating plate. The cutout portion and the grooves causes a gap between a large-diameter inner circumferential surface and an outer circumferential surface to communicate with the pressure chamber. The cutout portion and the grooves reduce a contact surface portion between the cylinder and the floating plate and divide the contact surface portion into multiple island portions. As a result, it is possible to reduce the contact surface portion.

14 Claims, 22 Drawing Sheets

FUEL INJECTION DEVICE

CROSS REFERENCE TO RELATED APPLICATION

This application is based on Japanese Patent Applications No. 2011-002319 filed on Jan. 7, 2011, and No. 2011-172454 filed on Aug. 6, 2011, the contents of which are incorporated herein by reference in its entirety.

TECHNICAL FIELD

The present invention relates to a fuel injection device provided with a pressure-responding control member, which regulates fuel pressure acting on a valve member for interrupting and allowing fuel injection from a nozzle hole.

BACKGROUND

Patent Document 1 (EP 1656498 B1), Patent Document 2 (JP 6-108948A corresponding to U.S. Pat. No. 4,826,080), and Patent Document 3 (JP Patent No. 4054621 corresponding to US 2003/0052198 A1) disclose regarding fuel injection devices provided with: a pressure chamber that exerts fuel pressure on a valve member for interrupting and allowing fuel injection from a nozzle hole; and a pressure regulating mechanism that regulates the pressure in the pressure chamber to move the valve member. With respect to the fuel injection devices, it is proposed to use a pressure-responding control member that is moved in response to a pressure change caused by opening/closing of an electromagnetic valve for the pressure regulating mechanism. Such a control member receives with fluid resistance at its surface of contact with any other member.

With the configurations of conventional technologies, there is a possibility that the following takes place when the area of a surface of contact between a control member and any other member is large: fluid resistance is increased and this degrades response. The viscosity of fuel varies according to temperature. For this reason, the fluid resistance arising from the contact surface portion varies according to temperature. As a result, when the area of a contact surface portion is large, fluctuation in fluid resistance is increased and this can cause injection characteristics to fluctuate.

SUMMARY

In view of the foregoing matters, it is an object of the present disclosure to provide a fuel injection device with excellent response.

It is another object of the invention to provide a fuel injection device that has stable fuel injection characteristics.

According to a first aspect of the present disclosure, a fuel injection device includes: a valve body having a passage for high-pressure fuel provided therein and having a nozzle hole for injecting the high-pressure fuel into a combustion chamber of an internal combustion engine at the tip thereof; a valve member movable in the valve body in an axial direction of the valve body to interrupt and allow supply of the high-pressure fuel to the nozzle hole; a housing member provided to face an end portion of the valve member, to define a pressure chamber for regulating a pressure of fuel acting on the valve member to control the movement of the valve member, and forming an inflow path for causing the high-pressure fuel to flow into the pressure chamber and an outflow path for causing the fuel to flow out of the pressure chamber; a control member arranged in the pressure chamber and brought into or out of contact with the housing member, to interrupt and allow communication at least between the inflow path and the pressure chamber; and a cylinder housing the control member such that the control member is movable in the axial direction. The cylinder includes: a large-diameter inner circumferential surface opposed to an outer circumferential surface of the control member; a small-diameter inner circumferential surface having an inside diameter smaller than an outside diameter of the outer circumferential surface of the control member; and a stepped surface provided between the large-diameter inner circumferential surface and the small-diameter inner circumferential surface and opposed to an end face of the control member on a side of the pressure chamber on a side of the pressure chamber. In the fuel injection device, a plurality of grooves are provided in the end face of the control member and/or the stepped surface of the cylinder, to divide a contact surface portion between the end face and the stepped surface into a plurality of island portions.

According to the above configuration, the contact surface portion is divided into multiple island portions by multiple grooves. This facilitates the discharge of fuel from between the contact surfaces and the inflow of fuel into between the contact surfaces and suppresses the fluid resistance at the contact surface portion.

According to a second aspect of the present disclosure, the multiple grooves may be provided in at least an area outside the small-diameter inner circumferential surface in the radial direction. In this case, the grooves are provided in an area outside the small-diameter inner circumferential surface that can be a contact surface portion in the radial direction. As a result, the contact surface portion is reduced and the fluid resistance at the contact surface portion is suppressed by the grooves.

According to a third aspect of the present disclosure, the multiple grooves may include grooves that causes the gap between the outer circumferential surface and the large-diameter inner circumferential surface to communicate with the pressure chamber. In this case, flow paths are provided and the fluid resistance at the contact surface portion is suppressed by the grooves.

According to a fourth aspect of the present disclosure, the multiple grooves may be formed in the control member so that they form a bow shape as viewed from the end face and include cutout portions that are open in the outer circumferential surface and the end face. In this case, the grooves that let the gap between the outer circumferential surface and the large-diameter inner circumferential surface and the pressure chamber to communicate with each other are provided mainly by the bow-shaped cutout portions. As a result, flow paths are provided and the fluid resistance at the contact surface portion is suppressed by the bow-shaped cutout portions.

According to a fifth aspect of the present disclosure, the multiple grooves may include multiple cutout portions. In this case, multiple island portions can be formed by the multiple cutout portions.

According to a sixth aspect of the present disclosure, the multiple grooves may include two cutout portions extended in parallel with each other along a diameter of the control member. In this case, multiple island portions can be formed by the two cutout portions extended along the diameter of the control member.

According to a seventh aspect of the present disclosure, the multiple grooves may include multiple cutout portions so arranged as to surround the periphery of the control member. In this case, the multiple cutout portions are so arranged as to surround the periphery of the control member. Therefore, it is possible to arrange multiple island portions so as to surround the periphery of the control member.

According to an eighth aspect of the present disclosure, the multiple grooves may include four cutout portions. In this case, at least four island portions can be formed by the four cutout portions.

According to a ninth aspect of the present disclosure, the cutout portion may be a chamfered portion formed in the corner portion between the outer circumferential surface and the end face of the control member. In this case, the cutout portion can be formed by chamfering.

According to a tenth aspect of the present disclosure, the multiple grooves may further include thin grooves thinner than a cutout portion. In this case, the contact surface portion left even after the bow-shaped cutout portion is provided can be divided by the thin grooves. As a result, the fluid resistance at the contact surface portion left even after the bow-shaped cutout portion is provided can be suppressed. When multiple cutout portions are provided, the thin grooves can be formed between the cutout portions.

According to an eleventh aspect of the present disclosure, the multiple grooves may include three or more grooves that divide the contact surface portion into three or more island portions. In this case, the three or more grooves can divide the contact surface portion into three or more island portions. As a result, the fluid resistance at the contact surface portion is suppressed.

According to a twelfth aspect of the present disclosure, the multiple grooves may include grooves formed in the control member. In this case, at least parts of the grooves are formed in the control member.

According to a thirteenth aspect of the present disclosure, the multiple grooves may include grooves formed in the cylinder. In this case, at least parts of the grooves can be formed in the cylinder.

According to a fourteenth aspect of the present disclosure, the outer circumferential surface may include: a large-diameter outer circumferential surface opposed to the large-diameter inner circumferential surface; and a small-diameter outer circumferential surface positioned between the large-diameter outer circumferential surface and the stepped surface and surrounding the end face. In this case, the outer circumferential surface of the control member includes: the large-diameter outer circumferential surface opposed to the large-diameter inner circumferential surface; and the small-diameter outer circumferential surface positioned between the large-diameter outer circumferential surface and the stepped surface and surrounding the end face. That is, the control member can be formed in the shape of a stepped circular column having a large diameter portion and a small diameter portion. Thus, the end face is surrounded with the small-diameter outer circumferential surface and the outside diameter of the end face is thereby reduced. As a result, the area of the contact surface portion can be reduced.

BRIEF DESCRIPTION OF THE DRAWINGS

Additional objects and advantages of the present disclosure will be more readily apparent from the following detailed description of preferred embodiments when taken together with the accompanying drawings. In which.

EMBODIMENTS

Figure 1:
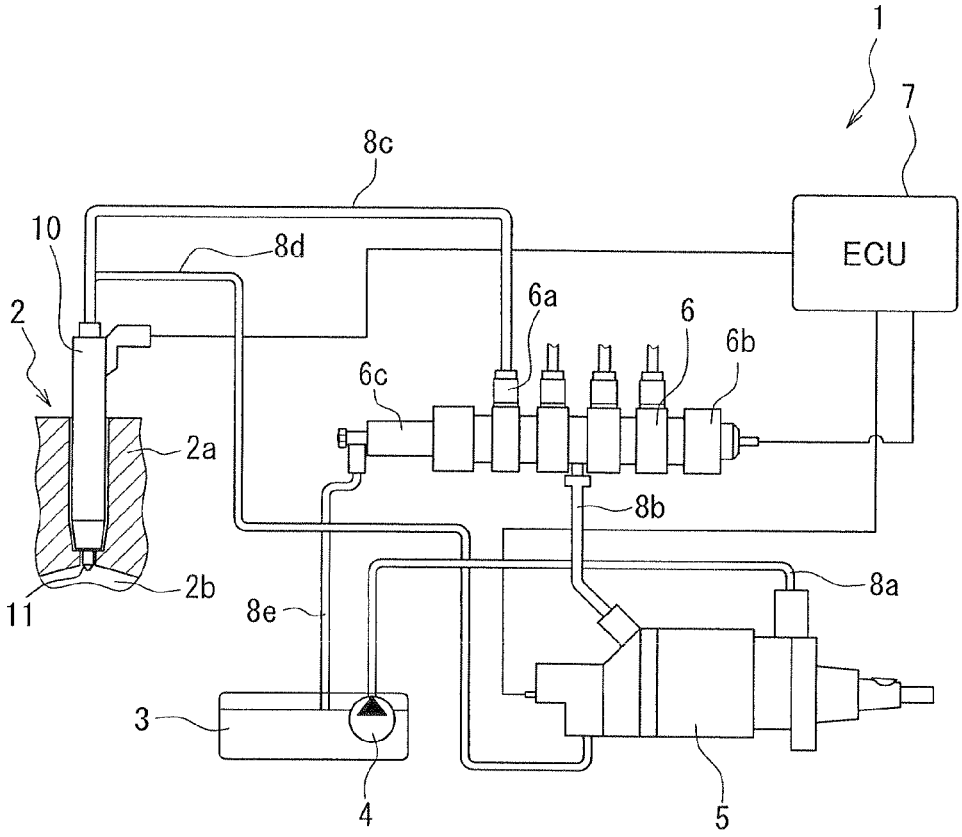
FIG. 1 is a block diagram illustrating a fuel supply system in a first embodiment of the invention.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

FIG. 1 is a block diagram illustrating a fuel supply system 1 in the first embodiment to which the invention is applied. In the fuel supply system 1, a fuel injection device 10 in the first embodiment is used. The fuel supply system 1 supplies fuel to an internal combustion engine 2. The internal combustion engine 2 is a multi-cylinder diesel engine. The head member 2*a* of the internal combustion engine 2 defines each combustion chamber 2*b*. The fuel supply system 1 is a direct injection type fuel supply system. The fuel injection device 10 injects fuel directly into a combustion chamber 2*b*. The fuel supply system 1 includes a fuel tank 3, a feed pump 4, a high-pressure fuel pump 5, a common rail 6, an electronic control unit (ECU) 7, and the fuel injection device 10.

The feed pump 4 is an electric pump. The feed pump 4 is housed in the fuel tank 3. The feed pump 4 is connected to the high-pressure fuel pump 5 through a fuel pipe 8*a*. The feed pump 4 gives a predetermined feed pressure to the liquid-phase fuel in the fuel tank 3 and supplies it to the high-pressure fuel pump 5. The fuel pipe 8*a* may be provided with a regulator for regulating the pressure of fuel to a predetermined value.

The high-pressure fuel pump 5 is attached to the internal combustion engine 2. The high-pressure fuel pump 5 is driven by the output shaft of the internal combustion engine 2. The high-pressure fuel pump 5 is connected to the common rail 6 through a fuel pipe 8*b*. The high-pressure fuel pump 5 adds pressure to the fuel supplied by the feed pump 4 and supplies it to the common rail 6. The high-pressure fuel pump 5 includes an electromagnetic valve electrically connected with the ECU 7. The opening/closing of the electromagnetic valve is controlled by the ECU 7. The ECU 7 controls the electromagnetic valve so as to regulate the pressure of fuel supplied from the high-pressure fuel pump 5 to the common rail 6 to a predetermined pressure.

The common rail 6 is a tubular member formed of a metal material, such as chrome molybdenum steel. In the common rail 6, there are formed multiple branch portions 6*a* corresponding to the number of cylinders. One branch portion 6*a* is connected to one fuel injection device 10 through a fuel pipe forming a supply flow path 8*c*. The fuel supply system 1 includes multiple fuel injection devices 10. Each fuel injection device 10 and the high-pressure fuel pump 5 are connected with each other through a fuel pipe forming a return flow path 8*d*. The common rail 6 temporarily stores high-pressure fuel supplied from the high-pressure fuel pump 5. The common rail 6 distributes the high-pressure fuel to the multiple fuel injection devices 10 through a supply flow path 8*c*. The common rail 6 has a common rail sensor 6*b* at one end of the ends thereof in the axial direction. The common rail 6 has a pressure regulator 6*c* at the other end. The common rail sensor 6*b* is electrically connected to the ECU 7 and detects the pressure and temperature of high-pressure fuel and outputs them to the ECU 7. The pressure regulator 6*c* regulates the pressure of high-pressure fuel to a constant pressure and depressurizes surplus fuel and discharges it. The surplus fuel that passed through the pressure regulator 6*c* is returned to the fuel tank 3 through a flow path in a fuel pipe 8*e* connecting the common rail 6 and the fuel tank 3 to each other.

Each fuel injection device 10 is a fuel injection valve that directly injects high-pressure fuel from a nozzle hole 11 into a combustion chamber 2*b*. Each fuel injection device 10 includes a valve mechanism that controls the injection of high-pressure fuel from a nozzle hole 11 according to a control signal from the ECU 7. The valve mechanism includes a main valve 12 for interrupting and allowing the injection of high-pressure fuel and a control valve 13. Each fuel injection device 10 uses part of high-pressure fuel supplied from a supply flow path 8*c* to drive and control a valve mechanism. The fuel used to drive and control a valve mechanism is discharged into a return flow path 8*d* that lets a fuel injection device 10 and the high-pressure fuel pump 5 communicate with each other and is returned to the high-pressure fuel pump 5. Each fuel injection device 10 is inserted and installed in an insertion hole in the head member 2*a* of the internal combustion engine 2. Each fuel injection device 10 injects fuel with so high a pressure as 160 to 220 Mega pascal (MPa) or the like.

The ECU 7 is made up of a microcomputer and the like. The ECU 7 is electrically connected with multiple sensors. The sensors may include: the above-mentioned common rail sensor 6*b*; a revolution speed sensor for detecting the revolution speed of the internal combustion engine 2; a throttle sensor for detecting a throttle opening; an air flow sensor for detecting the quantity of intake air; a boost pressure sensor for detecting boost pressure; a coolant temperature sensor for detecting cooling water temperature; an oil temperature sensor for detecting the temperature of lubricating oil; and the like. The ECU 7 outputs the following electrical signals to the electromagnetic valve of the high-pressure fuel pump 5 and each fuel injection device 10 based on information from the sensors: electrical signals for controlling the opening/closing of the electromagnetic valve of the high-pressure fuel pump 5 and the valve mechanism of each fuel injection device 10.

Figure 2:
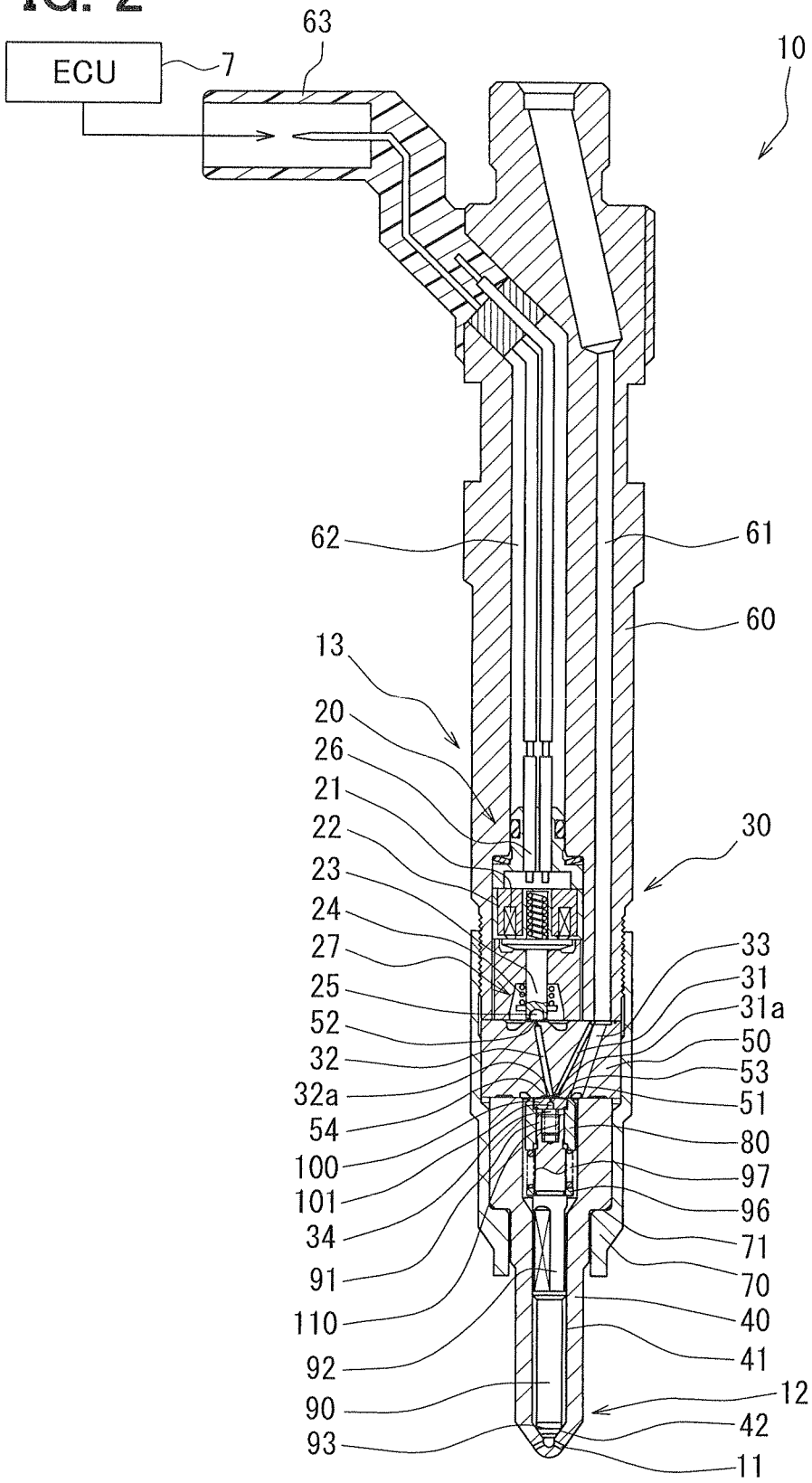
FIG. 2 is a sectional view illustrating a fuel injection device in the first embodiment.

FIG. 2 is a sectional view illustrating a fuel injection device 10 in the first embodiment. The fuel injection device 10 includes an electromagnetic drive portion 20, a body 30, a nozzle needle 90, and a floating plate 100.

The drive portion 20 is housed in the body 30. The drive portion 20 is a pilot type electromagnetic valve. The drive portion 20 comprises a control valve 13. The drive portion 20 includes a solenoid 21, a stator 22, a moving element 23, a spring 24, a valve seat member 25, and a terminal 26. The terminal 26 is a current-carrying member. One end of the terminal 26 is exposed from the body 30 to the outside. The other end of the terminal 26 is connected with the solenoid 21. The solenoid 21 is supplied with a pulse current from the ECU 7 through the terminal 26. When energized, the solenoid 21 generates a magnetic field. The stator 22 is a cylindrical member formed of a magnetic material. The stator 22 guides magnetic flux generated by the solenoid 21. The moving element 23 is a two-staged columnar member formed of a magnetic material. The moving element 23 is placed on the tip side of the stator 22 in the axial direction. When the solenoid 21 is energized, the moving element 23 is attracted toward the stator 22. The spring 24 is a coil spring. The spring 24 biases the moving element 23 in such a direction that it is brought away from the stator 22. The valve seat member 25 forms a pressure control valve 27 together with the control valve seat 52 of the body 30. The valve seat member 25 is provided at an end of the moving element 23 in the axial direction. The valve seat member 25 is seated on the control valve seat 52 and can stop the passage of fluid. When the solenoid 21 is not energized, the valve seat member 25 is kept seated on the control valve seat 52 by the biasing force from the spring 24. When the solenoid 21 is energized, the valve seat member 25 is separated from the control valve seat 52.

The body 30 includes a nozzle body 40, an orifice member 50, a holder 60, a retaining nut 70, and a cylinder 80. The nozzle body 40, orifice member 50, and holder 60 are arranged in this order from the tip side where the nozzle hole 11 is provided. The body 30 defines and forms an inflow path 31, an outflow path 32, a main supply path 33, and a pressure chamber 34. The body 30 provides an abutment surface 51 exposed in the pressure chamber 34 by the lower surface of the orifice member 50. One end of the inflow path 31 communicates with a supply flow path 8*c*. The other end of the inflow path 31 communicates with an inflow port 31*a* open in the abutment surface 51. One end of the outflow path 32 communicates with a return flow path 8*d* through the pressure control valve 27. The other end of the outflow path 32 communicates with an outflow port 32*a* open in the abutment surface 51. The pressure chamber 34 is defined by the cylinder 80, orifice member 50, and nozzle needle 90. The high-pressure fuel that passed through the supply flow path 8*c* can enter the pressure chamber 34 from the inflow port 31*a*. The fuel in the pressure chamber 34 can flow out to the return flow path 8*d* by way of the outflow port 32*a*.

The nozzle body 40 is a closed-end cylindrical member formed of a metal material, such as chrome molybdenum steel. The nozzle body 40 includes a nozzle needle housing portion 41, a valve seat 42, and a nozzle hole 11. The nozzle needle housing portion 41 is a cylindrical hole for housing the nozzle needle 90, formed along the direction of the axis of the nozzle body 40. The nozzle needle housing portion 41 is supplied thereinto with high-pressure fuel. The valve seat 42 is formed on the bottom wall of the nozzle needle housing portion 41. The valve seat 42 is so formed that it is in contact with the tip of the nozzle needle 90. The valve seat 42 provides the fixed-side valve seat of the main valve for interrupting and allowing the passage of high-pressure fuel. The nozzle hole 11 is positioned downstream of the valve seat 42. Multiple nozzle holes 11 are radially formed so that they are directed from inside to outside the nozzle body 40. As the result of passage of high-pressure fuel through the nozzle holes 11, it is atomized and diffused and becomes prone to be mixed with air. The nozzle body 40 is also referred to as nozzle member or valve body. The nozzle body 40 is a member having the following: a passage for high-pressure fuel formed therein and the nozzle holes 11 for injecting high-pressure fuel into a combustion chamber of the internal combustion engine, formed at the tip thereof.

The cylinder 80 is a cylindrical member formed of a metal material. The cylinder 80 defines the pressure chamber 34 together with the orifice member 50 and the nozzle needle 90. The cylinder 80 is placed in the nozzle needle housing portion 41 so that it is coaxial with the nozzle needle housing portion 41. One end face of the cylinder 80 is placed on the orifice member 50 side. The one end face of the cylinder 80 is pressed against the abutment surface 51 of the orifice member 50. As a result, the cylinder 80 is fixed and held on the orifice member 50. The cylinder 80 can be moved against the orifice member 50 but it may be considered as a member defining the pressure chamber 34 and belonging to the orifice member 50. Meanwhile, the cylinder 80 has its position in the radial direction governed by the nozzle body 40 through the nozzle needle 90; therefore, it may also be considered as a member belonging to the nozzle body 40.

The orifice member 50 is a columnar member formed of a metal material, such as chrome molybdenum steel. The orifice member 50 is placed and held between the nozzle body 40 and the holder 60. The orifice member 50 forms the abutment surface 51, control valve seat 52, inflow path 31, outflow path 32, and main supply path 33. The abutment surface 51 is formed in the central part in the radial direction of the end face of the orifice member 50 on the nozzle body 40 side. The abutment surface 51 is surrounded with the cylinder 80 and forms a circular shape. The control valve seat 52 is formed on the end face of the orifice member 50 on the holder 60 side among the end faces thereof in the axial direction. The control valve seat 52 comprises the pressure control valve 27 together with the valve seat member 25. The inflow path 31 is inclined from the central axis of the orifice member 50. The outflow path 32 is extended from the central part of the abutment surface 51 in the radial direction toward the control valve seat 52. The outflow path 32 is inclined from the central axis of the orifice member 50. The main supply path 33 lets the supply flow path 8*c* and the nozzle needle housing portion 41 communicate with each other.

The orifice member 50 has an inflow recessed portion 53, an outflow recessed portion 54, and the double annular abutment surface 51 formed in the surface opposed to the floating plate 100. The inflow recessed portion 53 is formed in the shape of an annular groove concentric with the central axis of the orifice member 50. The inflow recessed portion 53 is recessed from the top surface of the abutment surface 51. The inflow port 31*a* is open in the inflow recessed portion 53. The outflow recessed portion 54 is formed in the shape of a circular groove concentric with the central axis of the orifice member 50. The outflow recessed portion 54 is provided in the central part of the orifice member 50 in the radial direction. The outflow recessed portion 54 is circularly recessed from the top surface of the abutment surface 51. The inflow recessed portion 53 is positioned outside the outflow recessed portion 54 in the radial direction. The inner ring of the abutment surface 51 is positioned between the inflow recessed portion 53 and the outflow recessed portion 54. The inflow recessed portion 53 and the outflow recessed portion 54 are separated from each other by a flat seal provided by the inner ring of the abutment surface 51. When the top surface of the abutment surface 51 and the floating plate 100 are brought into contact with each other, the flat seal completely separates the inflow recessed portion 53 and the outflow recessed portion 54 from each other. The outer ring of the abutment surface 51 is positioned outside the inflow recessed portion 53 in the radial direction. The inflow recessed portion 53 and the nozzle needle housing portion 41 are separated from each other by a flat seal provided by the outer ring of the abutment surface 51. When the top surface of the abutment surface 51 and the floating plate 100 are brought into contact with each other, the flat seal completely separates the inflow recessed portion 53 and the nozzle needle housing portion 41 from each other.

The orifice member 50 is also referred to as housing member or orifice plate. The orifice member 50 defines the pressure chamber 34 that is so formed that it faces on an end portion of the nozzle needle 90 and that controls the movement of the nozzle needle 90 by regulating the pressure of fuel acting on the nozzle needle 90. Further, the orifice member 50 forms the inflow path 31 for letting high-pressure fuel flow into the pressure chamber 34 and the outflow path 32 for letting fuel flow out of the pressure chamber 34.

The holder 60 is a cylindrical member formed of a metal material, such as chrome molybdenum steel. The holder 60 includes vertical holes 61, 62 formed along the axial direction and a socket portion 63. The vertical hole 61 is a fuel flow path letting the supply flow path 8*c* and the inflow path 31 communicate with each other. The drive portion 20 is housed in the vertical hole 62 on the orifice member 50 side. The socket portion 63 is formed on the vertical hole 62 on the opposite side to the orifice member 50 so that it closes the opening of the vertical hole 62. One end of the terminal 26 of the drive portion 90 is protruded into the socket portion 63. The socket portion 63 is a connector that can be fit onto a plug connected with the ECU 7. When the socket portion 63 and the plug are connected with each other, a pulse current can be supplied from the ECU 7 to the drive portion 20.

The retaining nut 70 is a two-staged cylindrical member formed of a metal material. The retaining nut 70 houses part of the nozzle body 40, the orifice member 50, and part of the holder 60. The retaining nut 70 is screwed with the end of the holder 60 close to the orifice member 50. The retaining nut 70 has a stepped portion 71 formed in the inner circumferential wall portion thereof. The stepped portion 71 arrests the movement of the nozzle body 40. When the retaining nut 70 is attached to the holder 60, the nozzle body 40 and the orifice member 50 are pressed against the holder 60. The holder 60 and the retaining nut 70 clamp and hold the nozzle body 40 and the orifice member 50 in the axial direction.

The nozzle needle 90 is a member in the shape of a circular column as a whole, formed of a metal material, such as high-speed tool steel. The nozzle needle 90 includes a piston portion 91, sliding portions 92, and a seating portion 93. The piston portion 91 is a portion of the columnar outer circumferential wall of the nozzle needle 90 that positioned in the cylinder 80. The piston portion 91 is supported in the cylinder 80 so that it can slide on the inner surface of the cylinder 80. The sliding portions 92 are formed on the outer circumferential surface of the nozzle needle 90 at equal intervals. The sliding portions 92 are in contact with the inner surface of the nozzle body 40. The sliding portions 92 guide the nozzle needle 90 in the nozzle body 40 so that it can be moved in the axial direction. The seating portion 93 is formed at the end of the nozzle needle 90 located on the opposite side to the pressure chamber 34 of the ends thereof in the axial direction. The seating portion 93 can be seated on the valve seat 42. The seating portion 93 and the valve seat 42 form the main valve 12 for interrupting and allowing the flow of high-pressure fuel supplied into the nozzle needle housing portion 41 to the nozzle holes 11. An annular flange member 96 is attached to the stepped portion of the nozzle needle 90. The nozzle needle 90 is also referred to as valve member. The nozzle needle 90 moves in the nozzle body 40 in the direction of the axis of the nozzle body 40 and interrupts and resumes the supply of high-pressure fuel to the nozzle holes 11.

A return spring 97 is placed between the cylinder 80 and the nozzle needle 90 as is compressed. Since the cylinder 80 is in contact with the orifice member 50, it can be considered that the return spring 97 is placed between the orifice member 50 and the nozzle needle 90. The nozzle needle 90 is biased to the valve closing direction by the return spring 97. The return spring 97 is a coil spring. One end of the return spring 97 in the axial direction is abutted against the flange member 96 and the other end is abutted against an end face of the cylinder 80. The nozzle needle 90 is linearly reciprocated and displaced along the direction of the axis of the cylinder 80 in response to the following pressure difference: the pressure difference between the pressure of fuel acting on the piston portion 91 and the high-pressure fuel supplied into the nozzle needle housing portion 41. The nozzle needle 90 opens or closes the main valve 12 by seating or separating the seating portion 93 on or from the valve seat 42.

The floating plate 100 is housed in the cylinder 80. The floating plate 100 is a control member that controls the flow of fuel into and out of the pressure chamber 34. The floating plate 100 is a circular disk-like member formed of a metal material. The floating plate 100 is movably placed in the pressure chamber 34. The floating plate 100 is so arranged that the central axis thereof is parallel with the central axis of the cylinder 80. The floating plate 100 is placed coaxially with the cylinder 80. The floating plate 100 is so placed that it can be reciprocatively displaced mainly in the direction of the axis thereof. Of the end faces of the floating plate 100, one end face opposed to the abutment surface 51 can be abutted against the abutment surface 51. A gap large sufficient to allow the passage of fuel is formed between the outer circumferential surface of the floating plate 100 and the cylinder 80. A communication hole 101 penetrating the floating plate 100 in the axial direction is formed in the central part of the floating plate 100. The communication hole 101 lets the pressure chamber 34 and the outflow path 32 communicate with each other. The communication hole 101 is also a throttling portion. The communication hole 101 limits the quantity of flow of fuel passed through the communication hole 101.

When the floating plate 100 is separate from the abutment surface 51, the fuel that flowed in from the inflow port 31*a* passes between the floating plate 100 and the cylinder 80 and flows into the pressure chamber 34. When the floating plate 100 is seated on the abutment surface 51, the fuel in the pressure chamber 34 can flow out of the outflow port 32*a* by way of the communication hole 101. When the floating plate 100 is seated on the abutment surface 51, communication between the inflow port 31*a* and the pressure chamber 34 is interrupted. The floating plate 100 and the orifice member 50 provide a flow path switching valve that switches between the introduction of high-pressure fuel into the pressure chamber 34 and the discharge of fuel from the pressure chamber 34.

The floating plate 100 is a pressure-responding control member that is moved according to pressure controlled by the pressure control valve 27. The floating plate 100 is placed in the pressure chamber 34 and is brought into or out of contact with the orifice member 50 and thereby interrupts or allows communication at least between the inflow path 31 and the pressure chamber 34. The floating plate 100 is a member whose position in the radial direction is governed by the nozzle body 40. The orifice member 50 and the floating plate 100 form a flat seal for interrupting and allowing communication between the inflow path 31 and the pressure chamber 34.

A plate spring 110 is a coil spring. One end of the plate spring 110 in the axial direction is seated on an end face of the floating plate 100. The other end of the plate spring 110 in the axial direction is seated on the nozzle needle 90. The plate spring 110 is placed between the floating plate 100 and the nozzle needle 90 as is compressed in the axial direction. The plate spring 110 biases the floating plate 100 toward the abutment surface 51.

Figure 3:
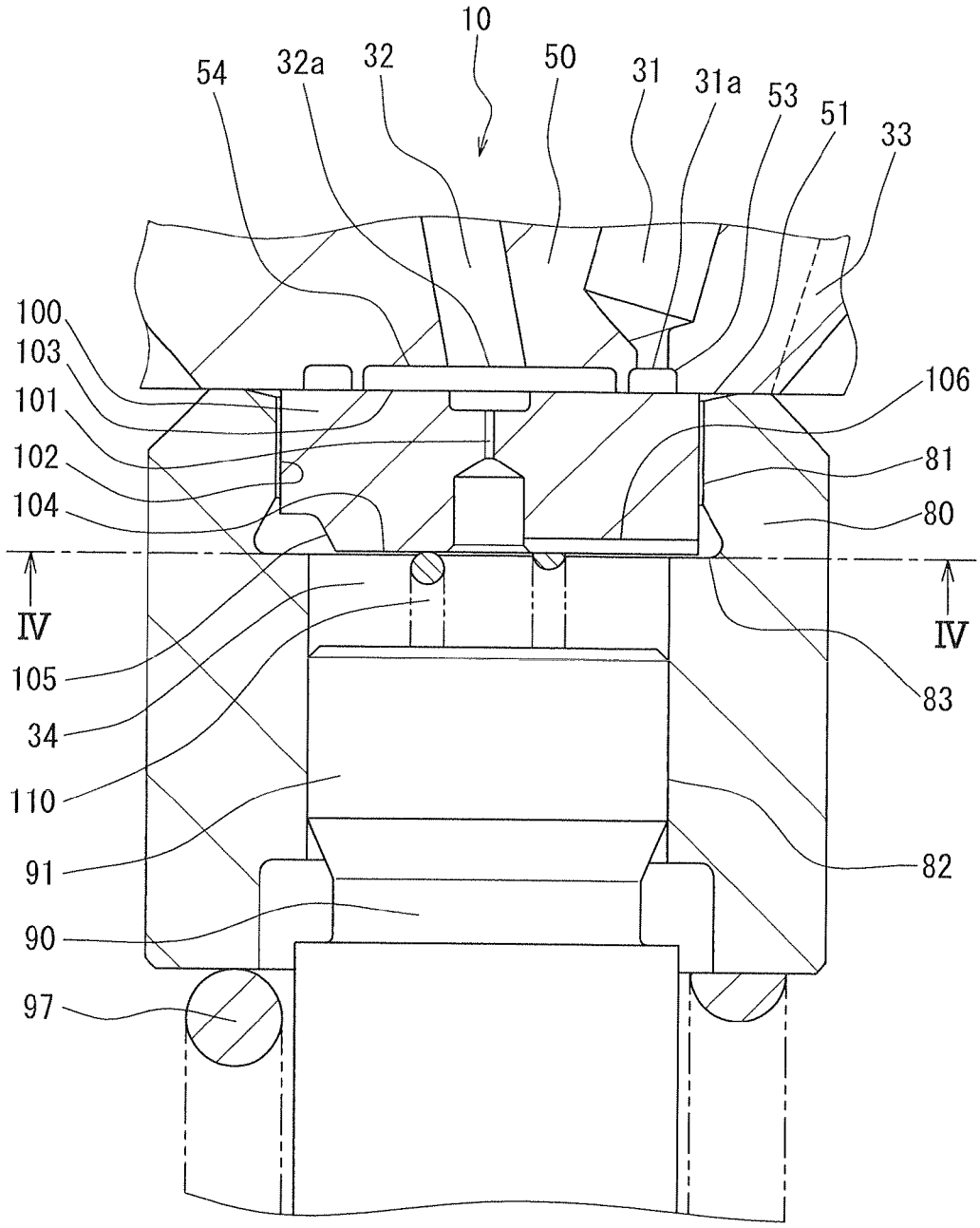
FIG. 3 is a partial enlarged sectional view illustrating a part of the fuel injection device, taken along the section of FIG. 4, in the first embodiment.
Figure 4:
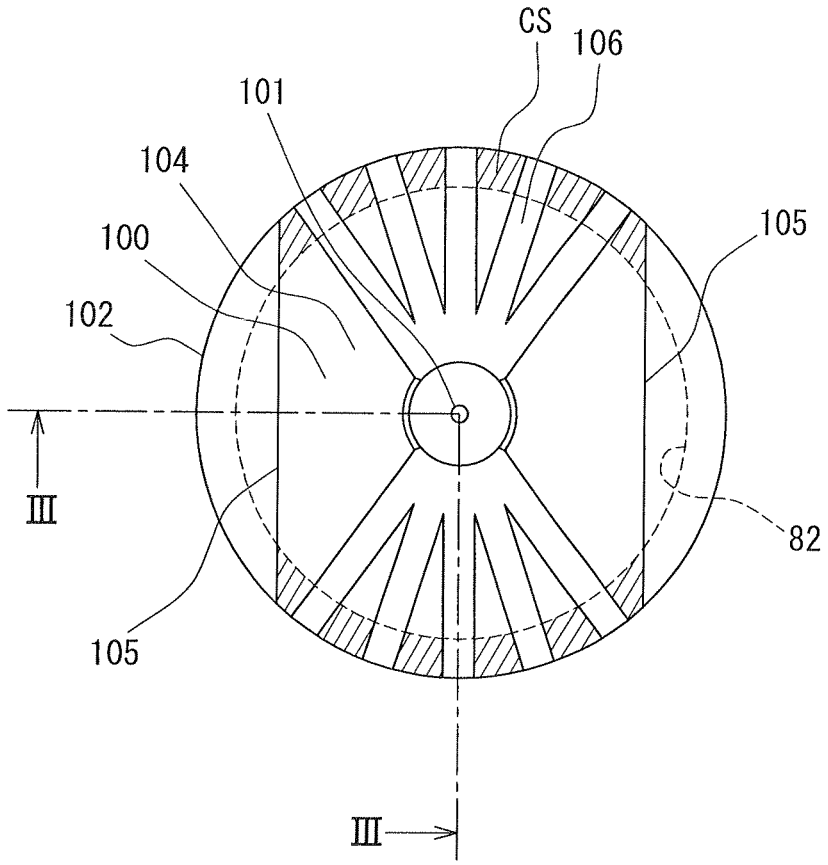
FIG. 4 is a partial sectional view illustrating the fuel injection device, taken along the section IV-IV of FIG. 3, in the first embodiment.

FIG. 3 is a partial enlarged sectional view illustrating a fuel injection device 10 in the first embodiment. FIG. 4 is a partial plan view illustrating the floating plate 100 of a fuel injection device 10 in the first embodiment. The drawing shows a plan view of the floating plate 100 as viewed from below. In the drawing, a broken line indicates the projected position of a small-diameter inner circumferential surface 82 and the hatched areas indicate a contact surface portion (contact surfaces).

The cylinder 80 is a cylindrical member. The inner surface of the cylinder 80 includes a large-diameter inner circumferential surface 81, the small-diameter inner circumferential surface 82, and a stepped surface 83. The inside diameter of the large-diameter inner circumferential surface 81 is larger than the inside diameter of the small-diameter inner circumferential surface 82. The large-diameter inner circumferential surface 81 is positioned on the orifice member 50 side in the direction of the axis of the cylinder 80. The inflow port 31*a* and the outflow port 32*a* are positioned radially inside of the large-diameter inner circumferential surface 81. The large-diameter inner circumferential surface 81 is opposed to the outer circumferential surface 102 of the floating plate 100. A narrow gap is formed between the large-diameter inner circumferential surface 81 and the outer circumferential surface 102. The depth of the large-diameter inner circumferential surface 81 in the axial direction is slightly larger than the thickness of the floating plate 100 in the axial direction. For this reason, the columnar space defined by the large-diameter inner circumferential surface 81 permits the floating plate 100 to slightly move in the axial direction. The small-diameter inner circumferential surface 82 is positioned on the opposite side to the orifice member 50 in the direction of the axis of the cylinder 80. The small-diameter inner circumferential surface 82 has an inside diameter smaller than the outside diameter of the outer circumferential surface 102 of the floating plate 100. The small-diameter inner circumferential surface 82 houses the piston portion 91 provided at an end of the nozzle needle 90 so that it can slide along the axial direction. The small-diameter inner circumferential surface 82 provides a sliding surface on the cylinder side. The small-diameter inner circumferential surface 82 forms a cylinder bore. The stepped surface 83 is an annular flat surface opposed to the orifice member 50. The stepped surface 83 is opposed to the outer edge portion of the end face 104 of the floating plate 100 in the radial direction. The stepped surface 83 is formed between the large-diameter inner circumferential surface 81 and the small-diameter inner circumferential surface 82. The cylinder 80 is so placed that it is pressed against the orifice member 50 and it thereby defines the pressure chamber 34 together with the orifice member 50.

The piston portion 91 is positioned inside of the small-diameter inner circumferential surface 82. The piston portion 91 is slidably supported on the small-diameter inner circumferential surface 82. The piston portion 91 defines the pressure chamber 34. The piston portion 91 receives the pressure of the fuel in the pressure chamber 34. The piston portion 91 is formed in a cylindrical shape and has a spring housing portion for housing part of the plate spring 110 formed therein.

The floating plate 100 is housed inside the large-diameter inner circumferential surface R1 of the cylinder 80 in the radial direction. A gap large sufficient to allow the passage of fuel is formed between the outer circumferential surface 102 of the floating plate 100 and the large-diameter inner circumferential surface 81 of the cylinder 80. The floating plate 100 includes an end face 103 opposed to the orifice member 50 and an end face 104 opposed to the stepped surface 83. The end face 103 is also referred to as upper surface. The end face 104 is also referred to as lower surface.

A cutout portion 105 is partly formed at the outer edge portion of the end face 104 in the radial direction. The cutout portion 105 is a linear recessed groove open astride the outer circumferential surface 102 and the end face 104. The cutout portion 105 forms in the end face 104 a straight ridge line positioned away from one diameter of the floating plate 100 and parallel with this diameter. Multiple cutout portions 105 are formed in the floating plate 100. In the floating plate 100, two cutout portions 105 are formed in parallel with each other. As a result, the end face 104 is partitioned by a pair of arcs positioned on the opposite sides in the direction of one diameter and a pair of straight lines positioned on the opposite sides in the direction of a diameter orthogonal to the diameter. One cutout portion 105 is formed in the floating plate 100 so that it forms a bow shape as viewed from the end face 104. The bow shape is a range surrounded with an arc and a bowstring connecting together both ends of this arc. The two cutout portions 105 can be formed by cutting off the corner portion between the outer circumferential surface 102 of the disk-shaped floating plate 100 and the end face 104. The two cutout portions 105 may also be considered as grooves formed in the floating plate 100. In this embodiment, therefore, the grooves that divide the contact surface portion between the end face 104 and the stepped surface 83 into multiple island portions CS include the cutout portions 105. The two cutout portions 105 are extended in parallel with each other along a diameter of the floating plate 100.

Each cutout portion 105 has a predetermined width from the outer circumferential surface 102 in the radial direction and has a predetermined depth from the end face 104 in the axial direction. The width of each cutout portion 105 is larger than the width of the stepped surface 83 in the radial direction. Each cutout portion 105 is extended to inside the small-diameter inner circumferential surface 82 in the radial direction and forms a passage communicating with the pressure chamber 34. For this reason, the fuel that passed through the gap between the outer circumferential surface 102 and the large-diameter inner circumferential surface 81 can flow into the pressure chamber 34 through the cutout portions 105.

In FIG. 3 and FIG. 4, multiple grooves 106 are formed in the end face 104. The grooves 106 are positioned only between the two cutout portions 105, 105. The grooves 106 are radially arranged.

The grooves 106 are directly open in the outer circumferential surface 102. The grooves 106 are open in the end face 104 inside the small-diameter inner circumferential surface 82 in the radial direction. The grooves 106 are open astride the outer circumferential surface 102 and the end face 104. However, each groove 106 is obviously smaller than each cutout portion 105. The flow path cross-sectional area provided by each of the grooves 106 is obviously smaller than the flow path cross-sectional area provided by one cutout portion 105. The flow path cross-sectional area is a cross-sectional area perpendicular to the flow of fuel flowing into the pressure chamber 34. For this reason, the fuel that passed through the gap between the outer circumferential surface 102 and the large-diameter inner circumferential surface 81 flows into the pressure chamber 34 mainly through the cutout portions 105. Only part of the fuel that passed through the gap between the outer circumferential surface 102 and the large-diameter inner circumferential surface 81 can flow into the pressure chamber 34 through the grooves 106.

At least parts of the grooves 106 are formed outside the small-diameter inner circumferential surface 82 in the end face 104 in the radial direction. The stepped surface 83 and the end face 104 overlap with each other within an annular range with respect to the axial direction. In the drawing, the range outside the small-diameter inner circumferential surface 82 in the radial direction and inside the outer circumferential surface 102 in the radial direction is the annular overlap range. This annular overlap range is a range that can be a contact surface portion between the stepped surface 83 and the end face 104. Of the annular overlap range in the floating plate 100, two approximately ¼ ranges positioned on the opposite sides in the radial direction are lost by the two cutout portions 105. That is, one approximately ¼ range of the annular overlap range is lost by one cutout portion 105. The other ¼ range positioned on the opposite side in the radial direction is lost by the other cutout portion 105.

Of the annular overlap range, one remaining ¼ range is divided into two or more island portions CS by multiple grooves 106. Of the annular overlap range, the other remaining ¼ range is also divided into two or more island portions CS by multiple grooves 106. These island portions CS are a contact surface portion between the stepped surface 83 and the end face 104. The multiple island portions CS, that is, the multiple contact surfaces are formed between a groove 106 and a groove 106 or between a groove 106 and a cutout portion 105.

The island portions CS are dispersedly arranged along the direction of the circumference of the floating plate 100 so that they are separated from one another. The cutout portions 105 are arranged on the end face 104 symmetrically with respect to a point and the grooves 106 are arranged on the end face 104 symmetrically with respect to a point. Therefore, the island portions CS are dispersed on the end face 104 symmetrically with respect to a point. As a result, when the floating plate 100 is abutted against the cylinder 80, the attitude of the floating plate 100 is stabilized.

When the end face 104 and the stepped surface 83 are brought close to each other, the grooves 106 facilitate the discharge of fuel from the island portions CS. When the end face 104 and the stepped surface 83 are brought away from each other, the grooves 106 facilitate the flow of fuel into the island portions CS. For this reason, the fluid resistance at the contact surface portion between the stepped surface 83 and the end face 104 can be suppressed by the grooves 106.

In this embodiment, the floating plate 100 is provided with the multiple grooves including the two cutout portions 105 and the multiple grooves 106. These grooves reduce the area of the contact surface portion between the floating plate 100 and the stepped surface 83. These grooves form flow paths for fuel. The cutout portions 105 can also be referred to as bow-shaped grooves. Meanwhile, the grooves 106 can also be referred to as linear grooves. Each cutout portion 105 is thicker than each groove 106 in the end face 104 and is deeper than each groove 106 in the outer circumferential surface 102. Consequently, the cutout portions 105 are also referred to as thicker grooves or deeper grooves. Meanwhile, each groove 106 is thinner than each cutout portion 105 in the end face 104 and is shallower than each cutout portion 105 in the outer circumferential surface 102. Consequently, the grooves 106 are also referred to as thinner grooves or shallower grooves. In this embodiment, the multiple grooves 105, 106 that divide the contact surface portion between the end face 104 and the stepped surface 83 into multiple island portions CS are formed only in the floating plate 100. In addition, the grooves 105, 106 include three or more grooves 105, 106 that divide the contact surface portion into three or more island portions.

Figure 5:
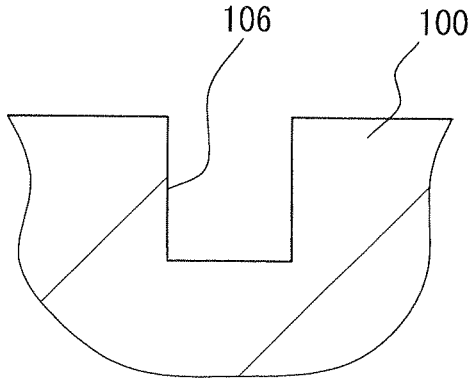
FIG. 5 is a partial sectional view illustrating the shape of a groove in the first embodiment.

FIG. 5 is a partial sectional view illustrating the shape of each groove 106 in the first embodiment. The groove 106 is recessed from the top surface of the end face 104. The groove 106 is a groove having a rectangular cross-sectional shape.

The fuel supply system 1 supplies high-pressure fuel to each fuel injection device 10. Each fuel injection device 10 injects fuel in response to a signal from the ECU 7.

When there is no signal from the ECU 7, the pressure control valve 27 is closed. High-pressure fuel is supplied into the nozzle needle housing portion 41. Meanwhile, the high-pressure fuel supplied from the inflow port 31*a* into the inflow recessed portion 53 acts so as to lift the floating plate 100 from the abutment surface 51. At this time, the pressure in the outflow recessed portion 54 is equal to the pressure in the pressure chamber 34 because of the communication hole 101. For this reason, the high-pressure fuel in the inflow recessed portion 53 pushes down the floating plate 100 and flows into the pressure chamber 34. When the pressure in the pressure chamber 34 rises, the floating plate 100 is seated on the abutment surface 51. Since the difference between the pressure in the nozzle needle housing portion 41 and the pressure in the pressure chamber 34 is small, the nozzle needle 90 is seated on the valve seat 42 and stops fuel injection from the nozzle holes 11.

When the solenoid 21 is excited by a signal from the ECU 7, the pressure control valve 27 is opened. When the pressure control valve 27 is opened, the fuel in the pressure chamber 34 flows out through the communication hole 101. This reduces the fuel pressure in the pressure chamber 34. Since the pressure in the outflow recessed portion 54 is low at this time, the floating plate 100 stays seated on the abutment surface 51. When the pressure in the pressure chamber 34 lowers, the high-pressure fuel supplied into the nozzle needle housing portion 41 pushes up the nozzle needle 90 toward the pressure chamber 34 against the return spring 97 at high speed. As a result, the nozzle needle 90 is separated from the valve seat 42 and fuel injection from the nozzle holes 11 is started.

When the excitation of the solenoid 21 is stopped by a signal from the ECU 7, the pressure control valve 27 is closed. This makes the pressure in the outflow recessed portion 54 equal to the pressure in the pressure chamber 34 because of the communication hole 101. As a result, the high-pressure fuel supplied from the inflow port 31*a* to the inflow recessed portion 53 slightly pushes down the floating plate 100 and flows into the pressure chamber 34. When the pressure of the pressure chamber 34 rises, the floating plate 100 is seated on the abutment surface 51. When the pressure of the pressure chamber 34 rises, the nozzle needle 90 is seated on the valve seat 42 and fuel injection from the nozzle holes 11 is stopped.

According to this embodiment, the resistance of fuel exerted on the floating plate 100 can be suppressed when the floating plate 100 is brought into contact with the cylinder 80 and/or when the floating plate 100 is brought away from the cylinder 80. For this reason, the response of the movement of the floating plate 100 is enhanced. Since the area of the contact surface portion is small, the response of the floating plate 100 does not fluctuate so much even when the temperature of fuel varies. For this reason, stable fuel injection characteristics are achieved.

Second Embodiment

Figure 6:
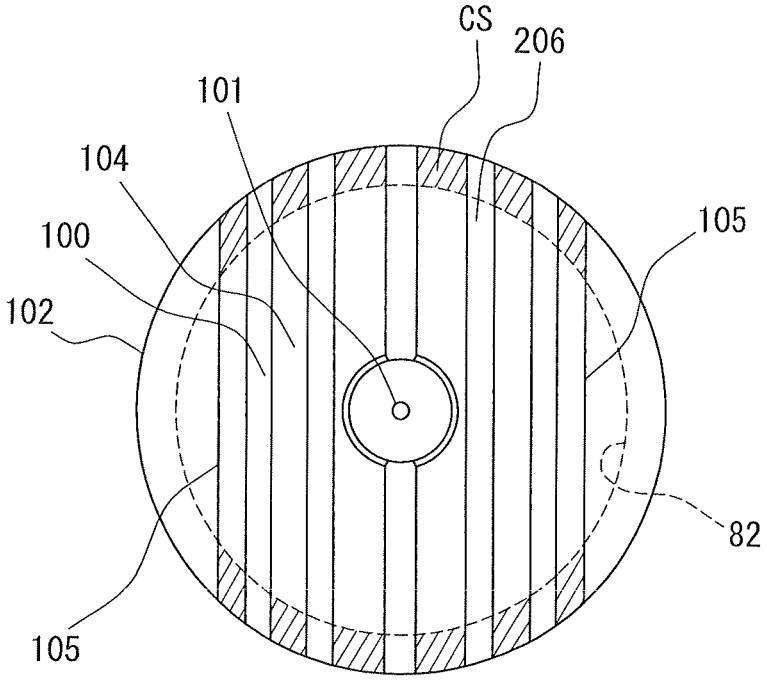
FIG. 6 is a partial sectional view illustrating a fuel injection device in a second embodiment of the invention.

FIG. 6 is a partial plan view illustrating the floating plate 100 of a fuel injection device 10 in a second embodiment to which the invention is applied. In the first embodiment, the multiple grooves 106 are radially arranged. Instead, the multiple grooves may be arranged in parallel with one another. In the end face 104, multiple grooves 206 are formed as shown in FIG. 6. The grooves 206 are arranged in parallel with one another. The grooves 206 are arranged also in parallel with the two cutout portions 105, 105. Also in this embodiment, the same action and effect as in the first embodiment can be obtained.

Third Embodiment

Figure 7:
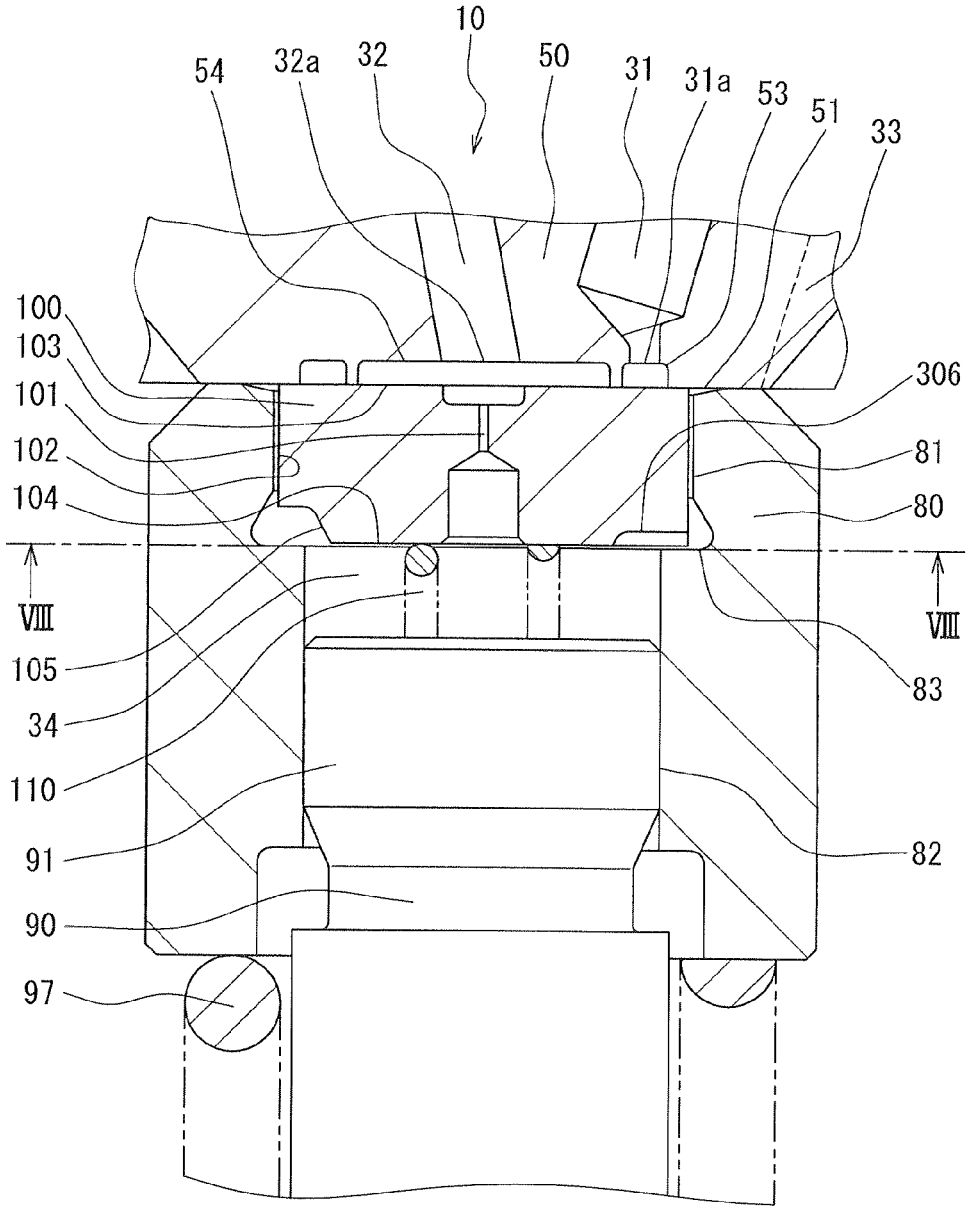
FIG. 7 is a partial enlarged sectional view illustrating a fuel injection device, taken along the section VII-VII of FIG. 8, in a third embodiment of the invention.
Figure 8:
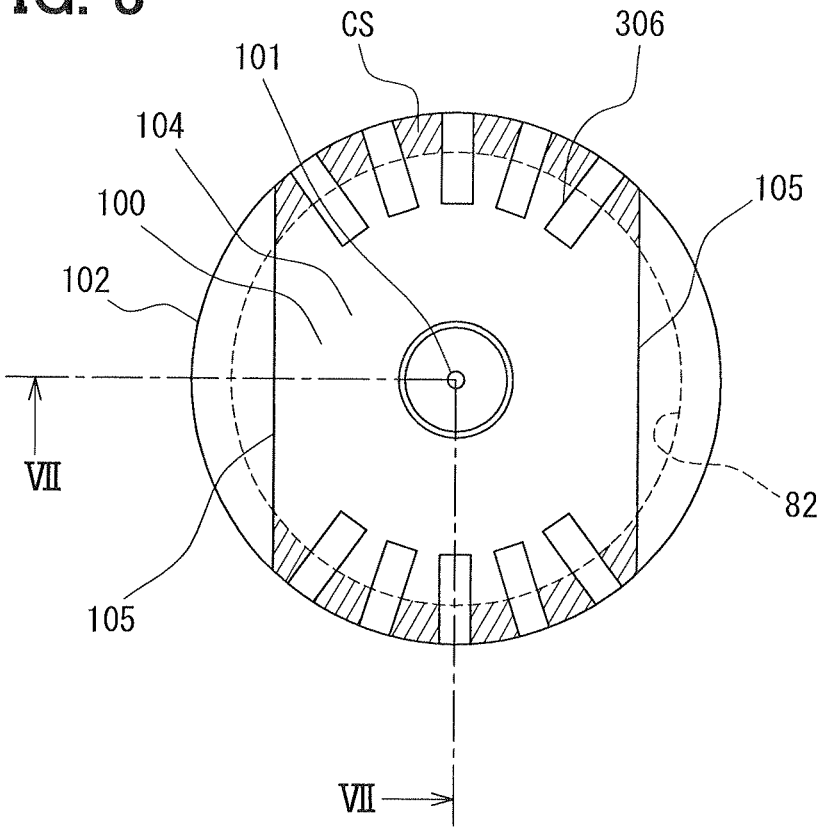
FIG. 8 is a partial sectional view illustrating the fuel injection device, taken along the section VIII-VIII of FIG. 7, in the third embodiment.

FIG. 7 is a partial enlarged sectional view illustrating a fuel injection device 10 in a third embodiment to which the invention is applied. FIG. 8 is a partial plan view illustrating the floating plate 100 of a fuel injection device 10 in the third embodiment. In the first embodiment, the grooves 106 extended across the diameters of the end face 104 are adopted. In this embodiment, multiple grooves 306 are adopted instead. The grooves 306 are radially extended in the end face 104. However, the grooves 306 do not exist in the central part of the end face 104. The grooves 306 are provided only in the outer area in the end face 104 in the radial direction. The grooves 306 are provided only outside the outside diameter of the plate spring 110 in the radial direction. The grooves 306 are provided at least outside the small-diameter inner circumferential surface 82 in the radial direction. Also in this embodiment, the same action and effect as in the first embodiment can be obtained. In addition, a stable seating face can be provided for the plate spring 110.

Fourth Embodiment

Figure 9:
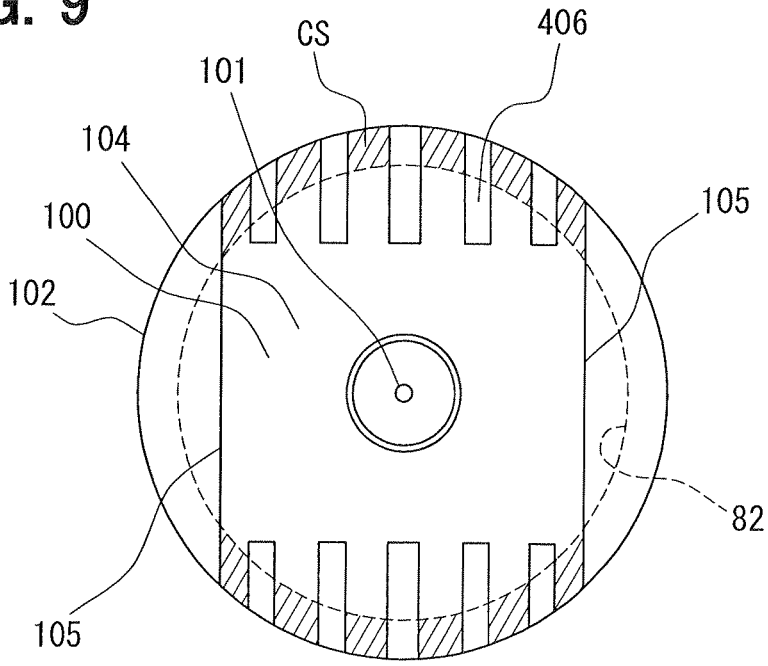
FIG. 9 is a partial sectional view illustrating a fuel injection device in a fourth embodiment of the invention.

FIG. 9 is a partial plan view illustrating the floating plate 100 of a fuel injection device 10 in the fourth embodiment to which the invention is applied. In the above embodiment, the multiple grooves 306 are radially arranged. Instead, the multiple grooves may be arranged in parallel with one another. In the end face 104, multiple grooves 406 are formed. Also in this embodiment, the same action and effect as in the above embodiment can be obtained.

Fifth Embodiment

Figure 10:
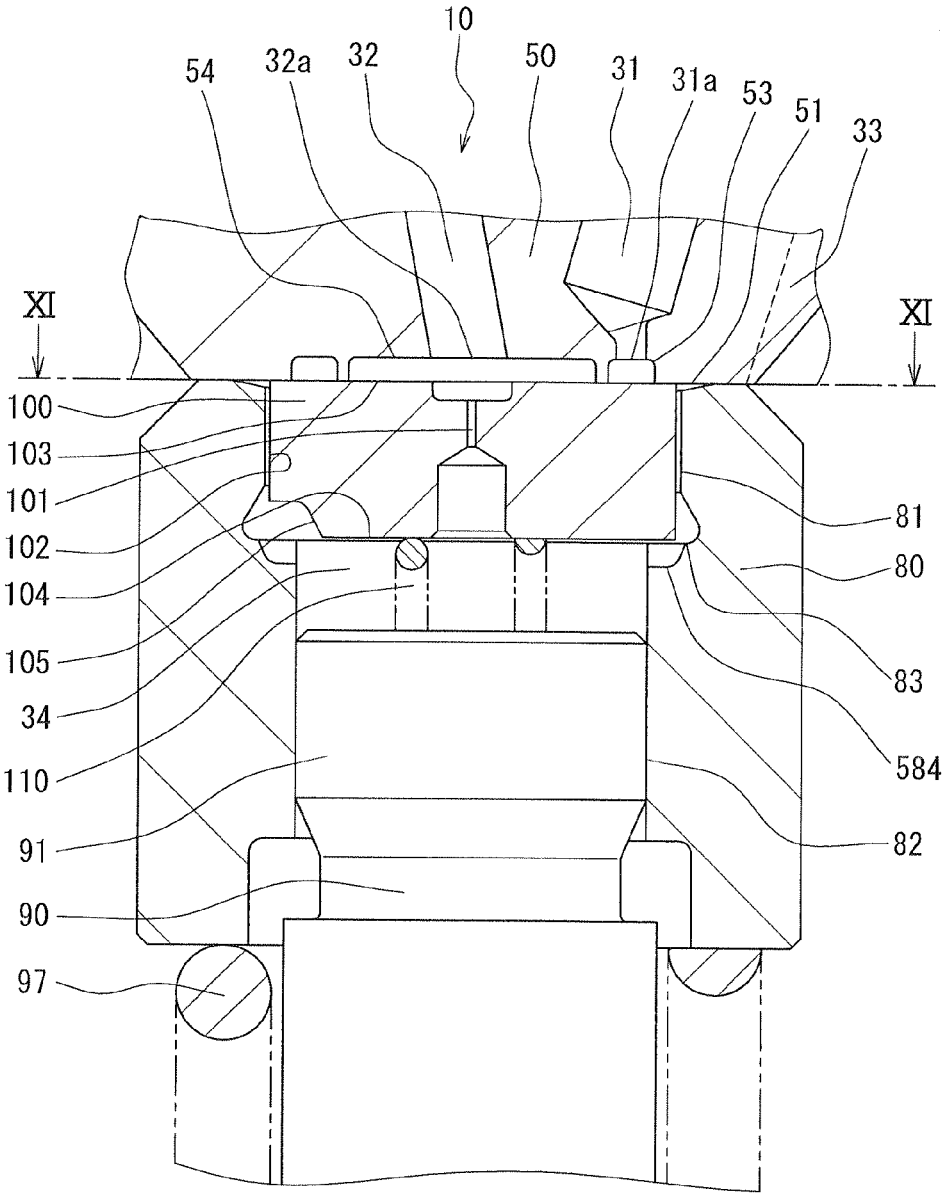
FIG. 10 is a partial enlarged sectional view illustrating a fuel injection device, taken along the section X-X of FIG. 11, in a fifth embodiment of the invention.
Figure 11:
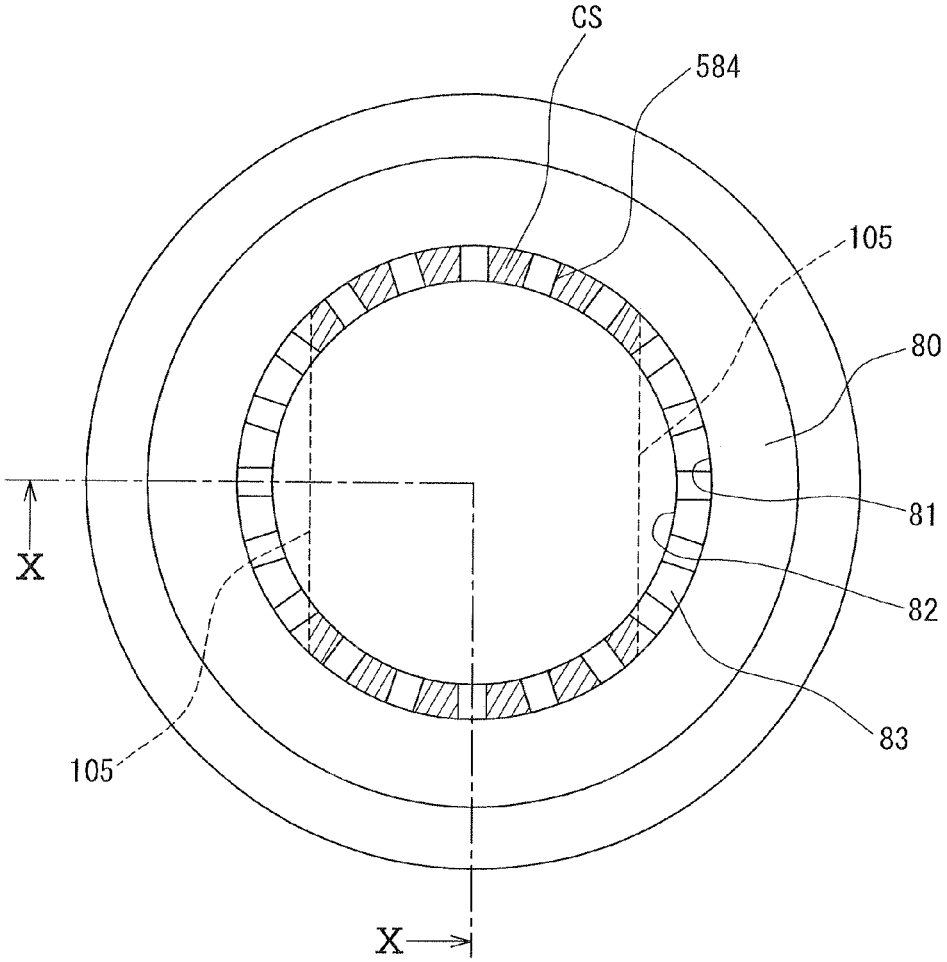
FIG. 11 is a partial sectional view illustrating the fuel injection device, taken along the section XI-XI of FIG. 10, in the fifth embodiment.

FIG. 10 is a partial enlarged sectional view illustrating a fuel injection device 10 in the fifth embodiment to which the invention is applied. FIG. 11 is a partial plan view illustrating the cylinder 80 of a fuel injection device 10 in the fifth embodiment. The drawing shows a plan view of the cylinder 80 as viewed from above. In the drawing, broken lines indicate the projected positions of the cutout portions 105 and the hatched ranges indicate contact surface portion.

In the above embodiments, the multiple grooves are formed only in the floating plate 100. In this embodiment, instead, multiple grooves 584 are also formed in the stepped surface 83 of the cylinder 80. The grooves 584 are recessed from the top surface of the stepped surface 83. The grooves 584 are radially arranged in the stepped surface 83. The grooves 584 are equally dispersedly provided along the direction of the circumference of the stepped surface 83.

In the floating plate 100, the cutout portions 105 are formed as ones of grooves that divide the contact surface portion (contact surfaces). In this embodiment, therefore, the multiple grooves 105, 584 that divide the contact surface portion between the end face 104 and the stepped surface 83 into multiple island portions CS are formed in the floating plate 100 and the cylinder 80.

The grooves 584 in the stepped surface 83 are open outside the outer circumferential surface 102 in the radial direction. The grooves 584 are open also in the small-diameter inner circumferential surface 82. Therefore, part of the fuel that passed through the gap between the outer circumferential surface 102 and the large-diameter inner circumferential surface 81 can flow into the pressure chamber 34 through the grooves 584. Also in this embodiment, the same action and effect as in the first embodiment can be obtained. In addition, a stable seating face can be provided for the plate spring 110.

Sixth Embodiment

Figure 12:
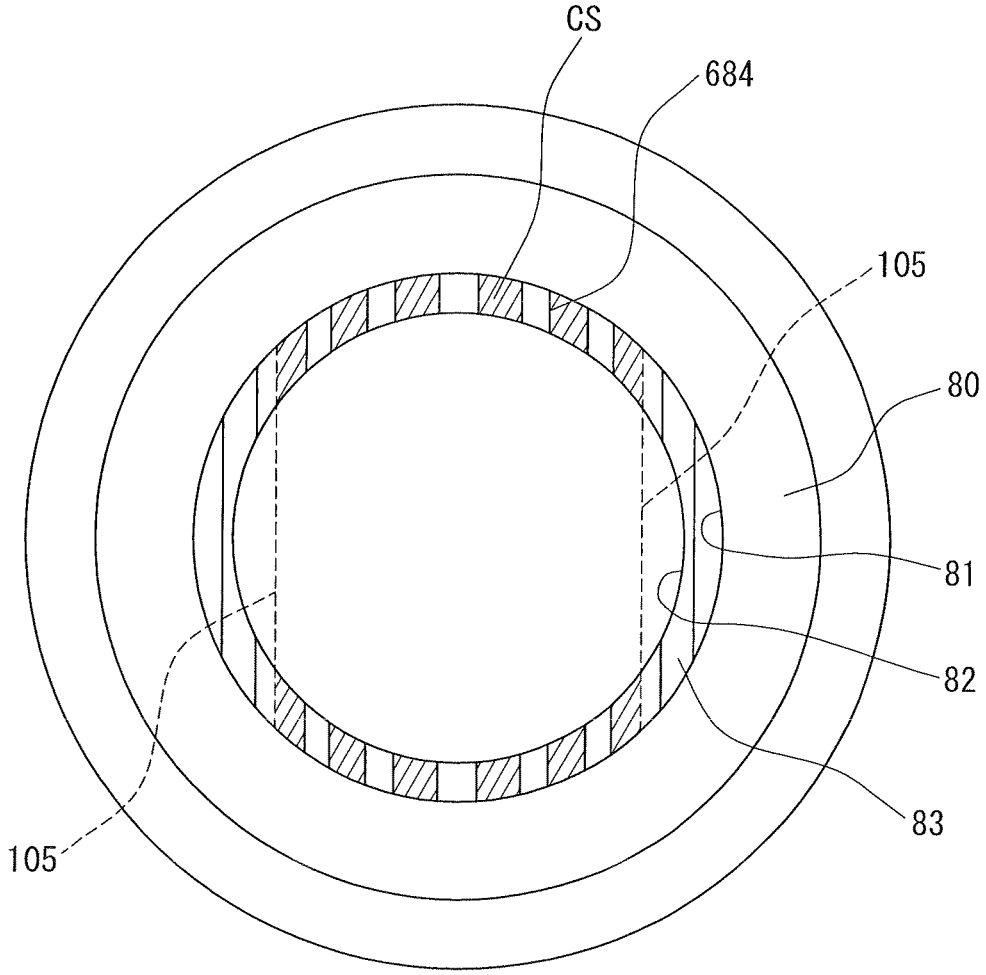
FIG. 12 is a partial sectional view illustrating a fuel injection device in a sixth embodiment of the invention.

FIG. 12 is a partial plan view illustrating the cylinder 80 of a fuel injection device 10 in the sixth embodiment to which the invention is applied. In the above embodiment, the multiple grooves 584 are radially arranged. Instead, the multiple grooves may be arranged in parallel with one another. In the stepped surface 83, multiple grooves 684 are formed. Also in this embodiment, the same action and effect as in the above embodiment can be obtained.

Seventh Embodiment

Figure 13:
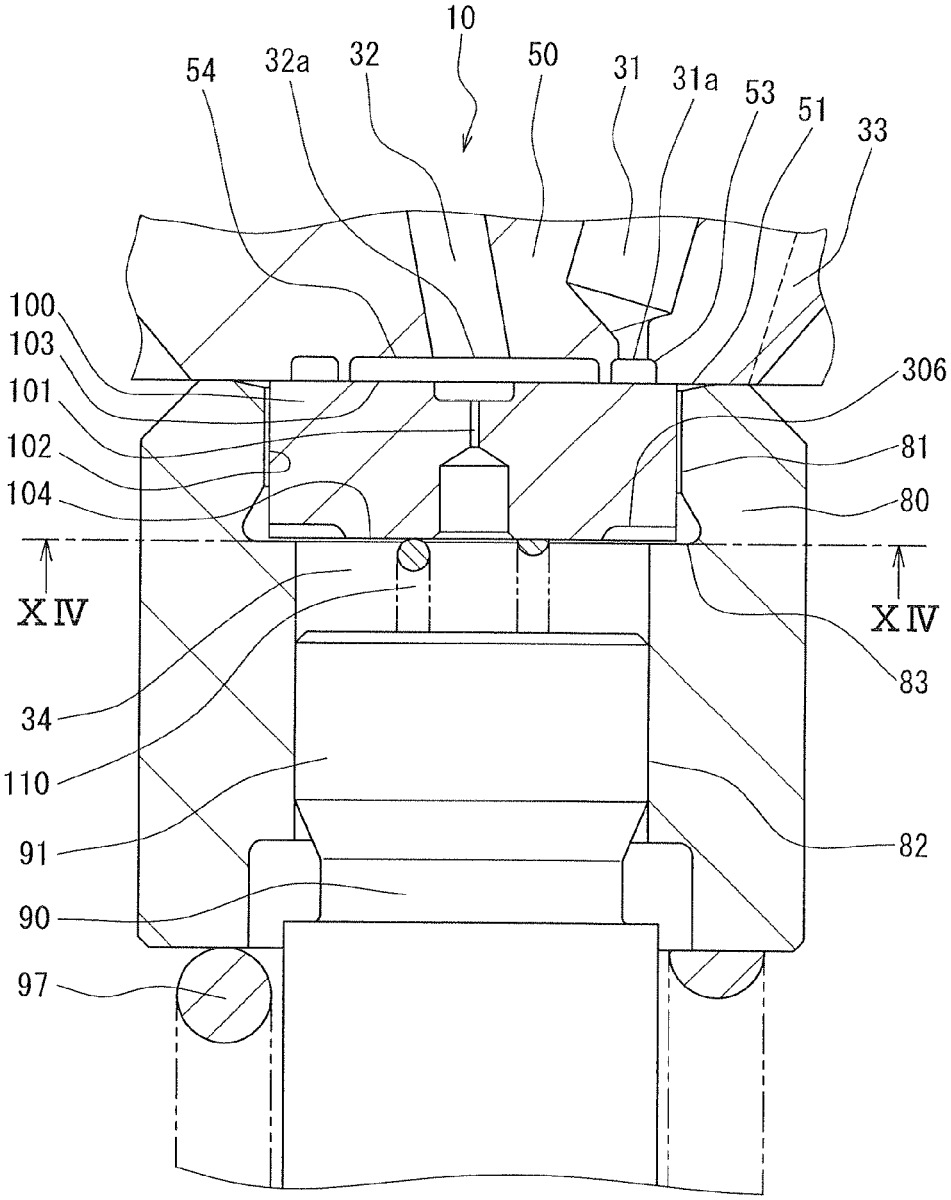
FIG. 13 is a partial enlarged sectional view illustrating a fuel injection device, taken along the section XIII-XIII of FIG. 14, in a seventh embodiment of the invention.
Figure 14:
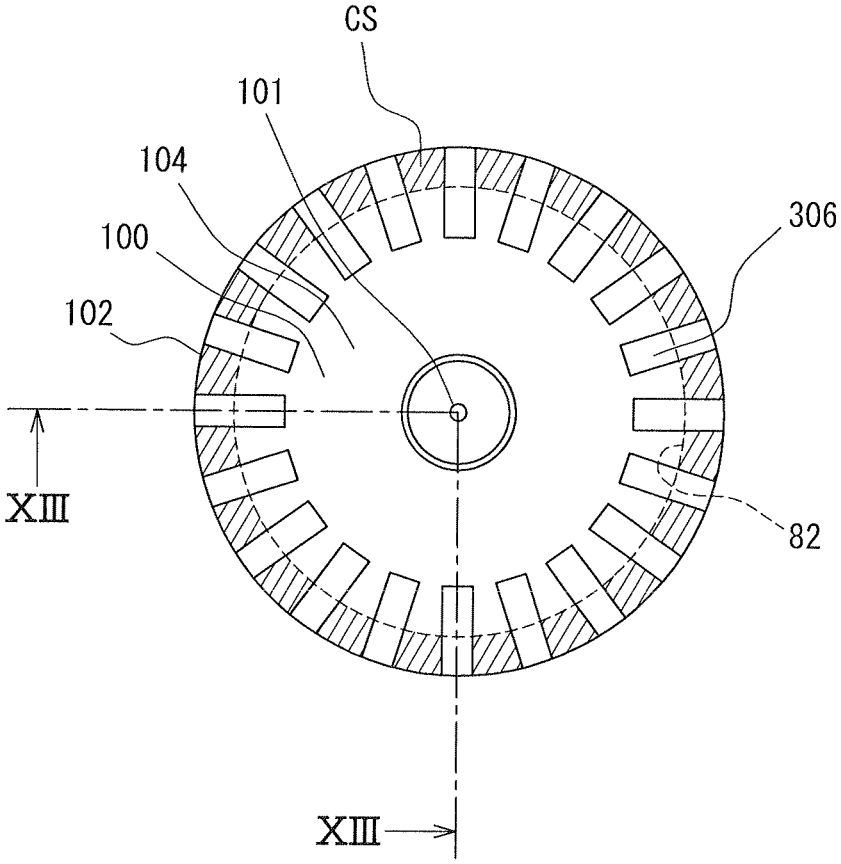
FIG. 14 is a partial sectional view illustrating the fuel injection device, taken along the section XIV-XIV of FIG. 13, in the seventh embodiment.

FIG. 13 is a partial enlarged sectional view illustrating a fuel injection device 10 in the seventh embodiment to which the invention is applied. FIG. 14 is a partial plan view illustrating the floating plate 100 of a fuel injection device 10 in the seventh embodiment. In the above multiple embodiments, the cutout portions 105 are provided. In this embodiment, instead, a floating plate 100 not provided with a cutout portion 105 is adopted. This embodiment is a modification to the third embodiment illustrated in FIG. 7 and FIG. 8. Multiple grooves 306 are formed all around the periphery of the end face 104. The grooves 306 are equally dispersedly provided along the direction of the circumference of the end face 104. The fuel that passed through the gap between the outer circumferential surface 102 and the large-diameter inner circumferential surface 81 can flow into the pressure chamber 34 only through the grooves 306. Also in this embodiment, the same action and effect as in the third embodiment can be obtained.

Eighth Embodiment

Figure 15:
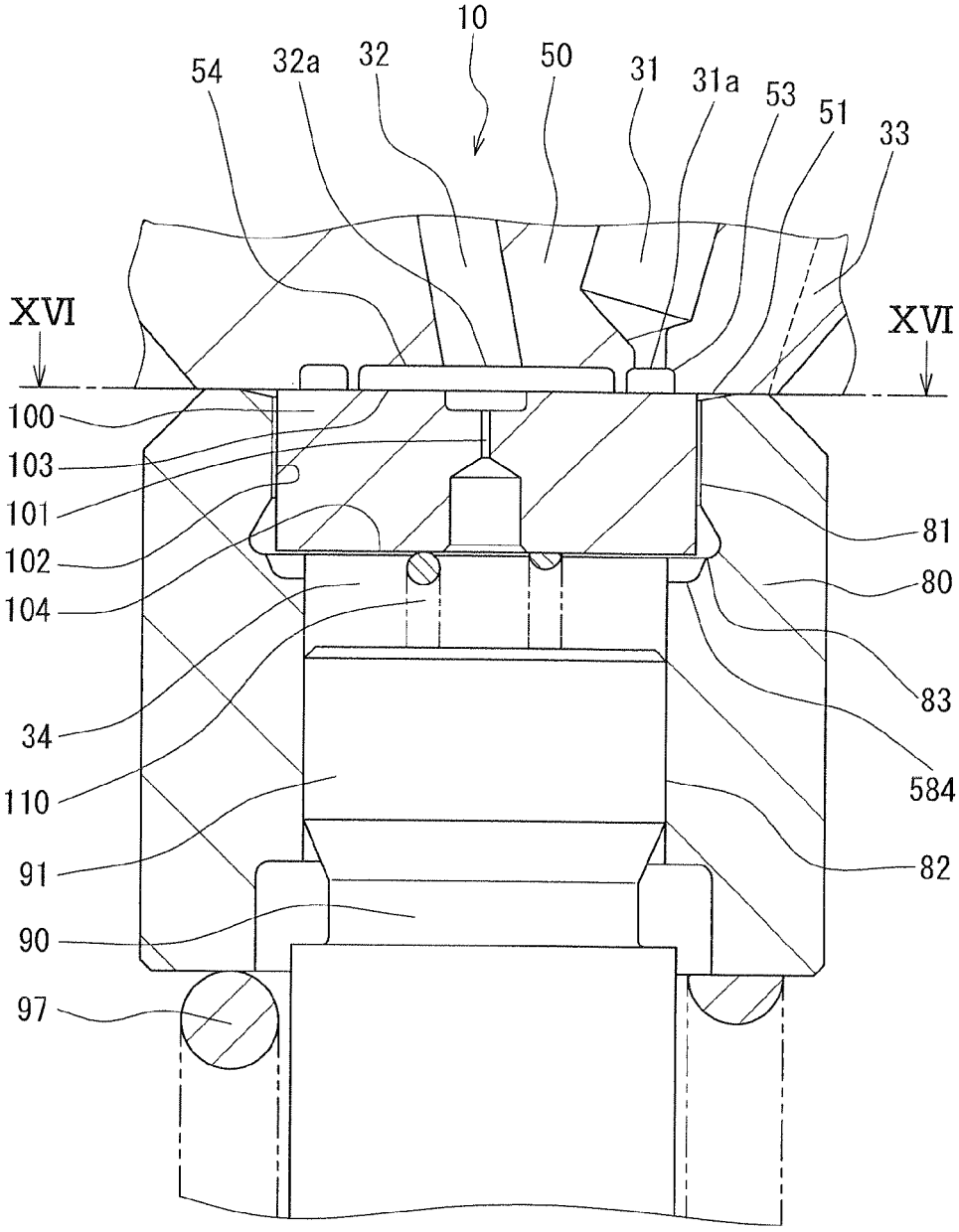
FIG. 15 is a partial enlarged sectional view illustrating a fuel injection device, taken along the section XV-XV of FIG. 16, in an eighth embodiment of the invention.
Figure 16:
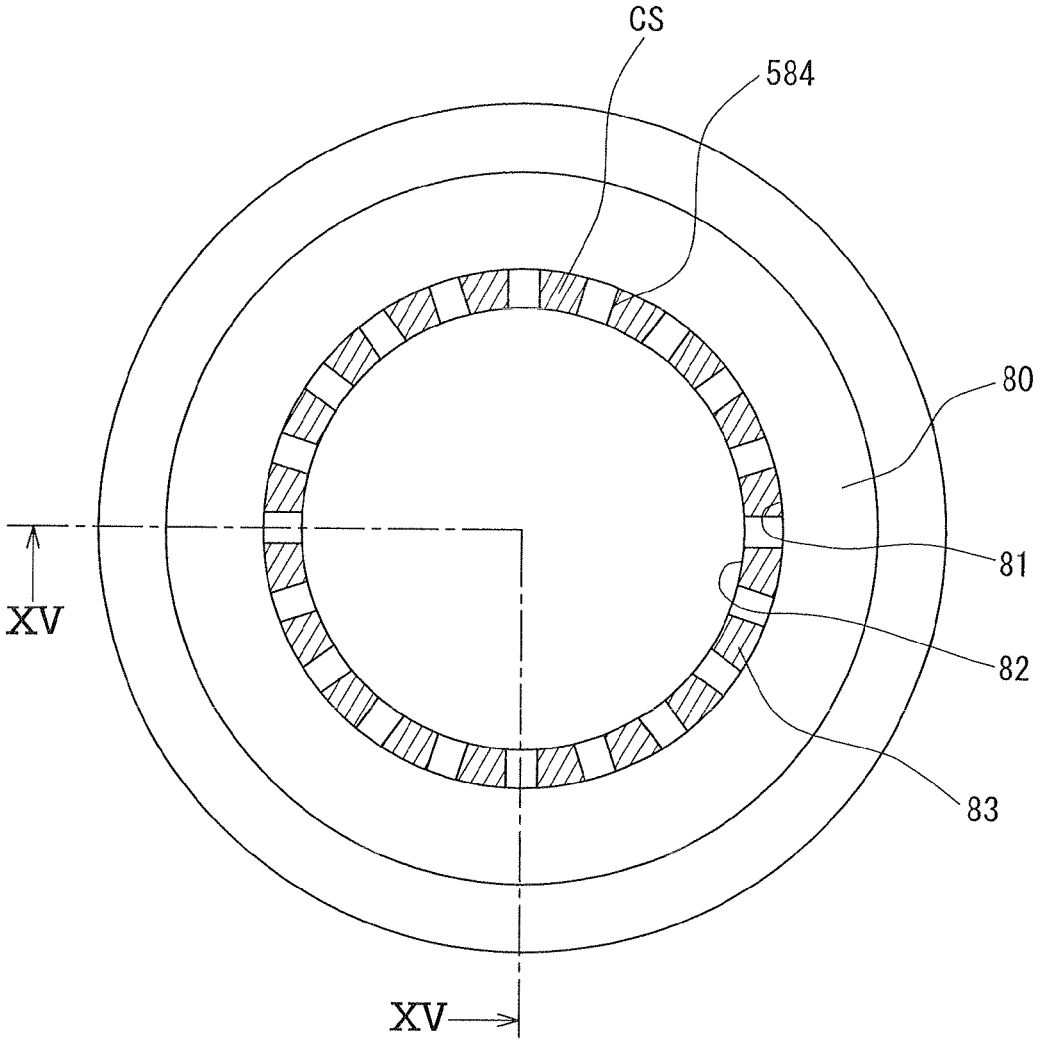
FIG. 16 is a partial sectional view illustrating a fuel injection device, taken along the section XVI-XVI of FIG. 15, in the eighth embodiment.

FIG. 15 is a partial enlarged sectional view illustrating a fuel injection device 10 in the eighth embodiment to which the invention is applied. FIG. 16 is a partial plan view illustrating the cylinder 80 of a fuel injection device 10 in the eighth embodiment. In this embodiment, a floating plate 100 not provided with a cutout portion 105 is adopted. This embodiment is a modification to the fifth embodiment illustrated in FIG. 10 and FIG. 11.

In this embodiment, multiple grooves 584 that divide the contact surface portion between the end face 104 and the stepped surface 83 into multiple island portions CS are formed only in the cylinder 80. The fuel that passed through the gap between the outer circumferential surface 102 and the large-diameter inner circumferential surface 81 can flow into the pressure chamber 34 only through the grooves 584. Also in this embodiment, the same action and effect as in the fifth embodiment can be obtained.

Ninth Embodiment

Figure 17:
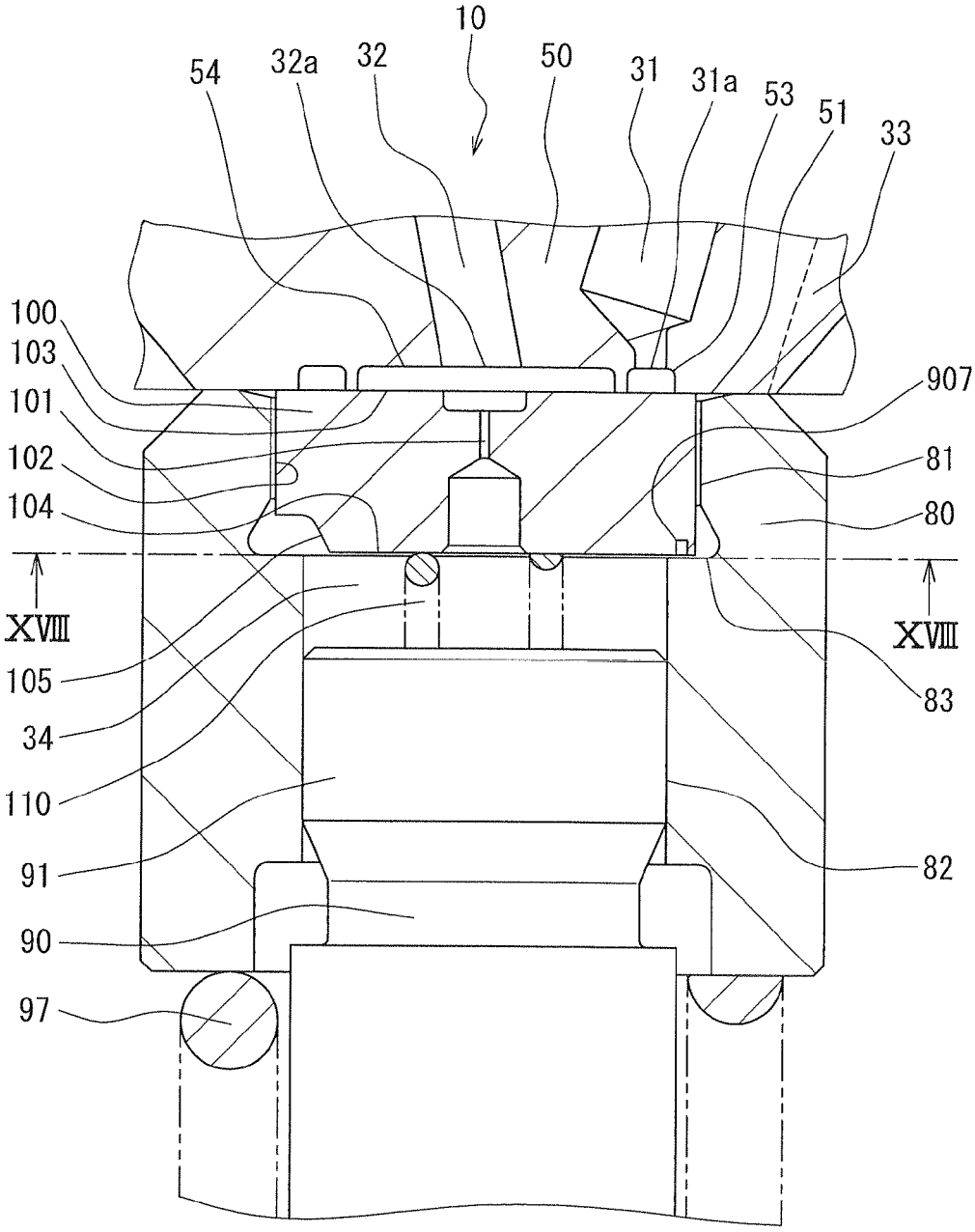
FIG. 17 is a partial enlarged sectional view illustrating a fuel injection device, taken along the section XVII-XVII of FIG. 18, in a ninth embodiment of the invention.
Figure 18:
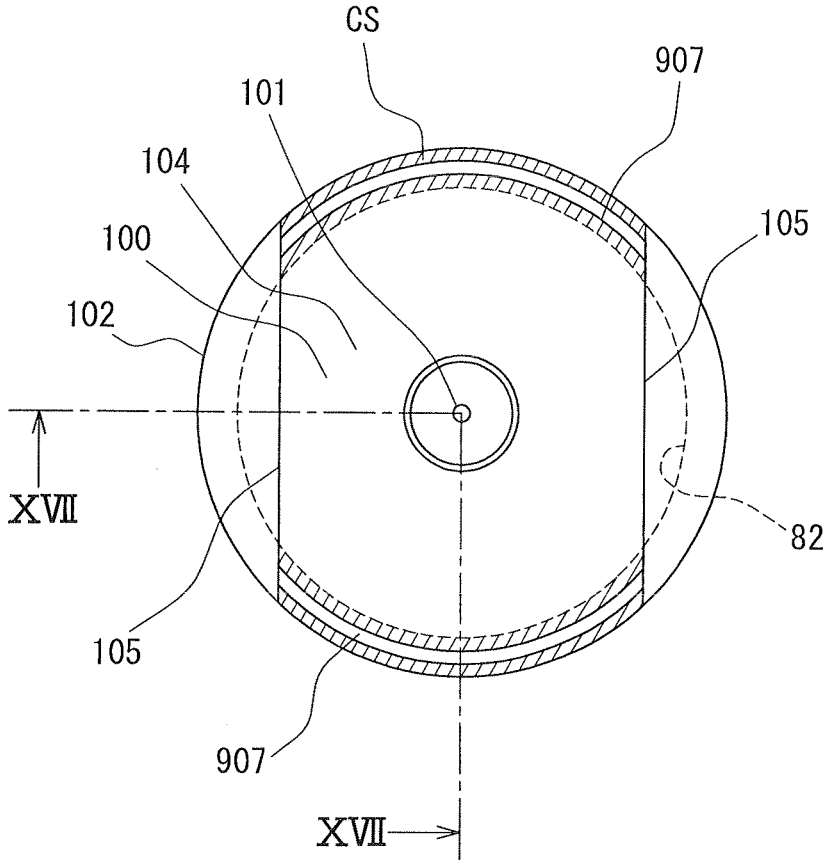
FIG. 18 is a partial sectional view illustrating the fuel injection device, taken along the section XVIII-XVIII of FIG. 17, in the ninth embodiment.

FIG. 17 is a partial enlarged sectional view illustrating a fuel injection device 10 in the ninth embodiment to which the invention is applied. FIG. 18 is a partial plan view illustrating the floating plate 100 of a fuel injection device 10 in the ninth embodiment. Above multiple embodiments adopt multiple grooves that let the gap between the outer circumferential surface 102 and the large-diameter inner circumferential surface 81 and the pressure chamber 34 communicate with each other. In this embodiment, instead, grooves 907 are adopted. Two arc-shaped grooves 907 are formed in the outer edge portion of the end face 104 in the radial direction. The grooves 907 divide the annular overlap range between the stepped surface 83 and the end face 104 in the radial direction. Of the annular overlap range, a substantially ¼ range is lost by one cutout portion 105. Of the annular overlap range, another approximately ¼ range is lost by the other cutout portion 105.

Of the annular overlap range, one remaining ¼ range is divided into multiple island portions CS by a groove 907. Of the annular overlap range, the other remaining ¼ range is also divided into multiple portions CS by a groove 907. These island portions CS are contact surfaces between the stepped surface 83 and the end face 104. The multiple island portions CS, that is, the multiple contact surfaces are formed between the grooves 907 and the outer circumferential surface 102 and between the grooves 907 and the small-diameter inner circumferential surface 82.

The width of each island portion CS in the radial direction is smaller than the width of the overlap range in the radial direction. The width of each island portion CS in the radial direction is equal to or less than /1;3 of the width of the stepped surface 83 in the radial direction.

According to the present embodiment, the resistance of fuel exerted on the floating plate 100 can be suppressed when the floating plate 100 is brought into contact with the cylinder 80 and/or when the floating plate 100 is brought away from the cylinder 80. For this reason, the response of the movement of the floating plate 100 can be enhanced. Since the contact surface portion is small, the response of the floating plate 100 does not fluctuate so much even when the temperature of fuel varies. For this reason, stable fuel injection characteristics are achieved.

10th Embodiment

Figure 19:
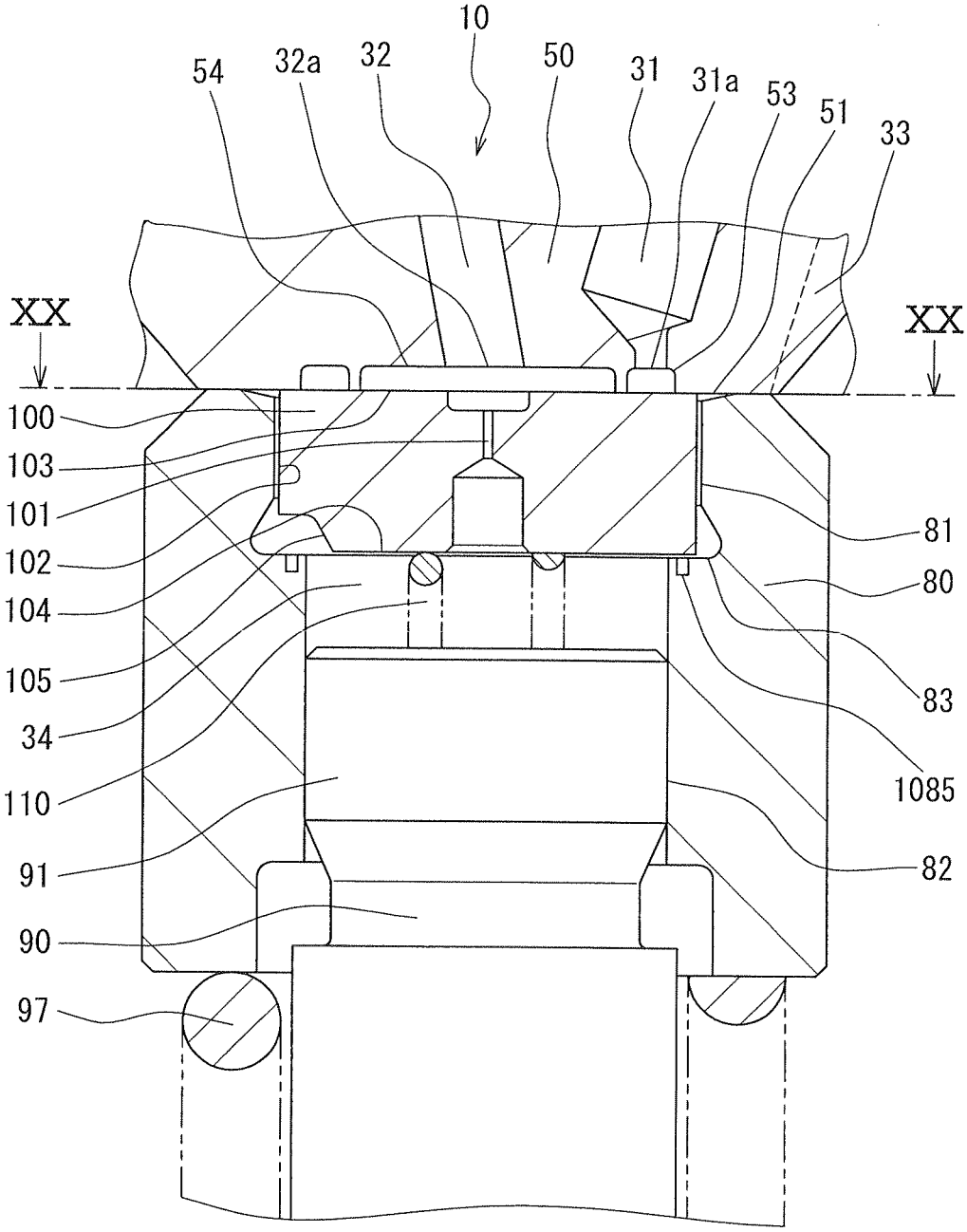
FIG. 19 is a partial enlarged sectional view illustrating a fuel injection device, taken along the section XIX-XIX of FIG. 20, in a 10th embodiment of the invention.
Figure 20:
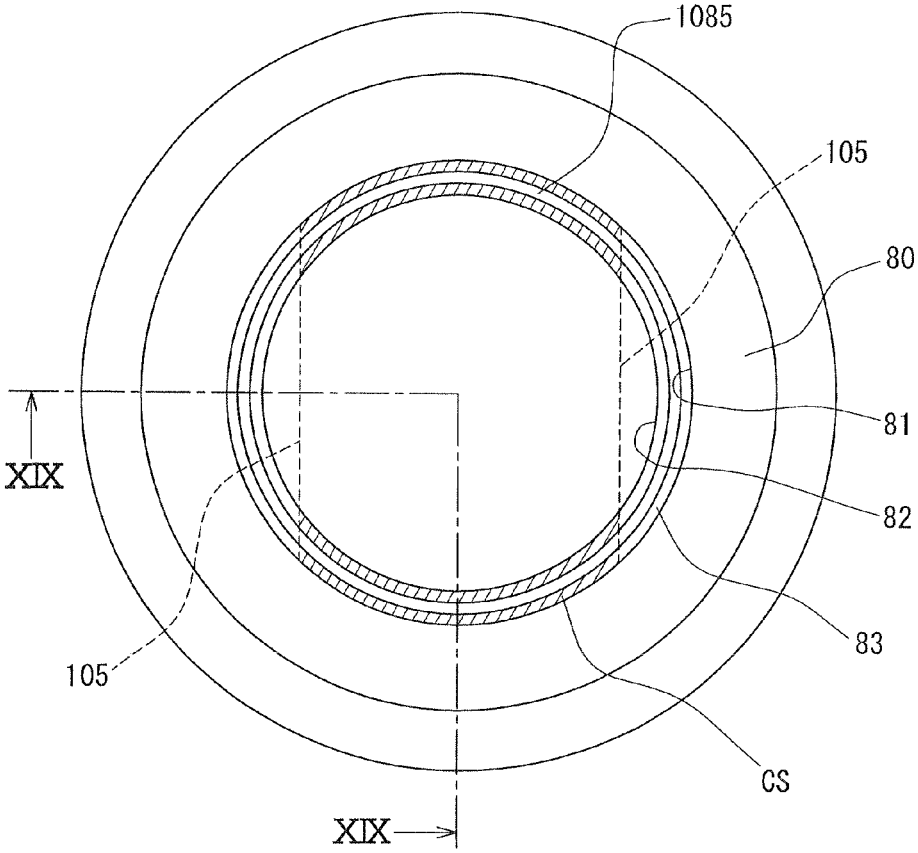
FIG. 20 is a partial sectional view illustrating a fuel injection device, taken along the section XX-XX of FIG. 19, in the 10th embodiment.

FIG. 19 is a partial enlarged sectional view illustrating a fuel injection device 10 in a 10th embodiment to which the invention is applied. FIG. 20 is a partial plan view illustrating the cylinder of a fuel injection device 10 in the 10th embodiment. In the above embodiment, the grooves 907 are formed in the floating plate 100. In this embodiment, instead, a groove 1085 is adopted. The annular groove 1085 is formed in the stepped surface 83. The groove 1085 divides the overlap range between the stepped surface 83 and the end face 104 in the radial direction. Also in this embodiment, multiple island portions CS are formed. Also in this embodiment, the same action and effect as in the above embodiment are achieved.

11th Embodiment

Figure 21:
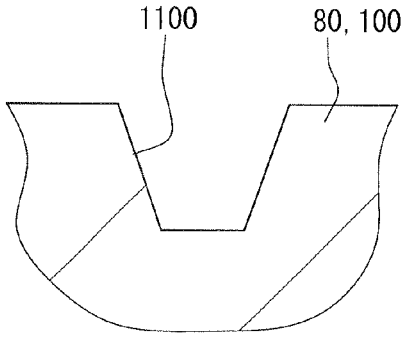
FIG. 21 is a partial sectional view illustrating the shape of a groove in an 11th embodiment of the invention.

FIG. 21 is a partial sectional view illustrating the shape of a groove in a modification to the above embodiments. The grooves 106, 206, 306, 406, 584, 684, 907, 1085 in the above-mentioned multiple embodiments may be formed of grooves 1100 having such a trapezoidal cross-sectional shape as shown in the drawing.

12th Embodiment

Figure 22:
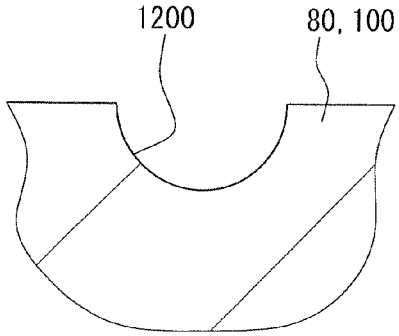
FIG. 22 is a partial sectional view illustrating the shape of a groove in a 12th embodiment of the invention.

FIG. 22 is a partial sectional view illustrating the shape of a groove in a modification to the above embodiments. The grooves 106, 206, 306, 406, 584, 684, 907, 1085 in the above-mentioned multiple embodiments may be formed of grooves 1200 having such an arc cross-sectional shape or semi-circular cross-sectional shape as illustrated in the drawing.

13th Embodiment

Figure 23:
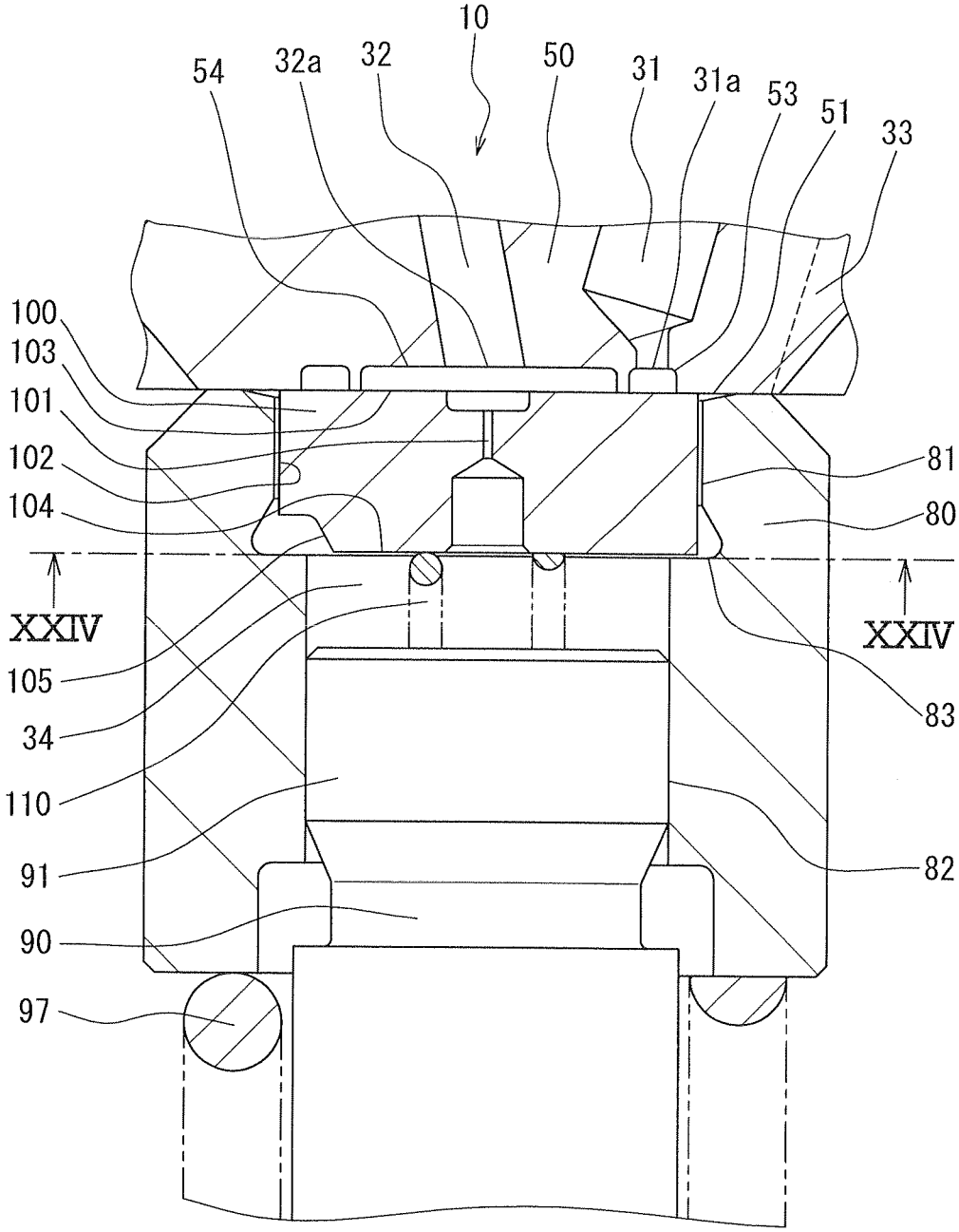
FIG. 23 is a partial enlarged sectional view illustrating a fuel injection device, taken along the section XXIII-XXIII of FIG. 24, in a 13th embodiment of the invention.
Figure 24:
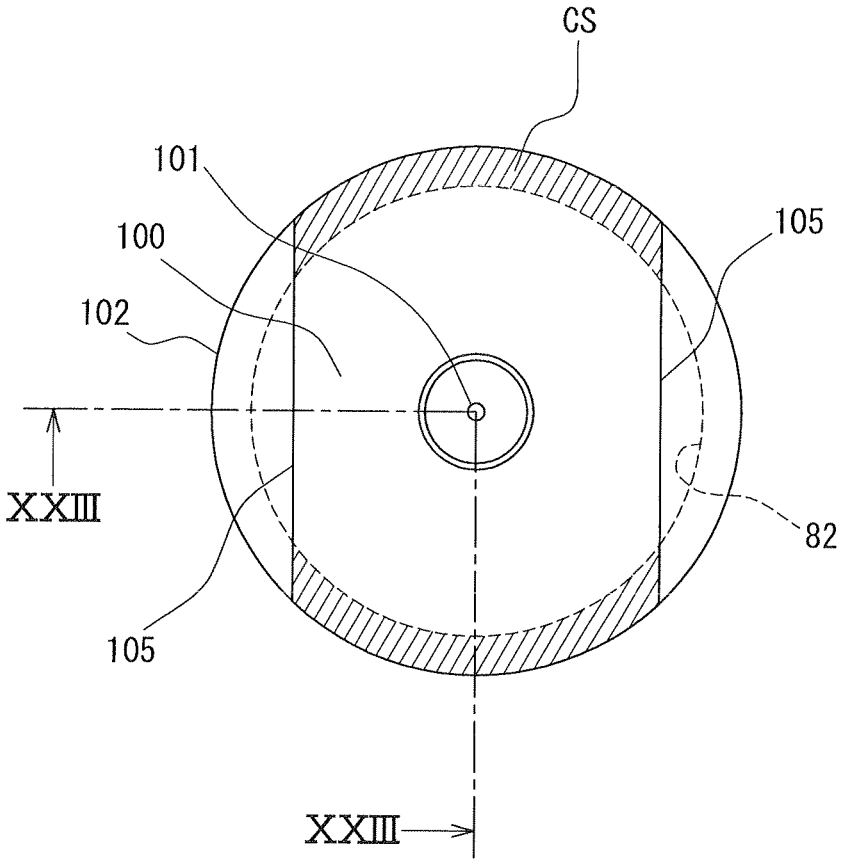
FIG. 24 is a partial sectional view illustrating the fuel injection device, taken along the section XXIV-XXIV of FIG. 23, in the 13th embodiment.

FIG. 23 is a partial enlarged sectional view illustrating a fuel injection device 10 in the 13th embodiment to which the invention is applied. FIG. 24 is a partial plan view illustrating the floating plate 100 of a fuel injection device 10 in the 13th embodiment. The 13th embodiment is a modification to the first embodiment illustrated in FIG. 1 to FIG. 5. In the end face 104, the multiple grooves 106 are not formed, but only two cutout portions 105 are formed. Therefore, only the cutout portions 105 are formed as the grooves in the floating plate 100.

The multiple cutout portion 105 divide the annular overlap range between the stepped surface 83 and the end face 104 in the circumferential direction and thereby form two island portions CS away from each other. Also in this embodiment, the area of the contact surface portion can be reduced by the cutout portions 105. In addition, flow paths for fuel can be formed by the cutout portions 105 when the floating plate 100 is seated on the stepped surface 83 of the cylinder 80. According to this embodiment, the response of the movement of the floating plate 100 can be enhanced. Further, stable fuel injection characteristics are achieved.

14th Embodiment

Figure 25:
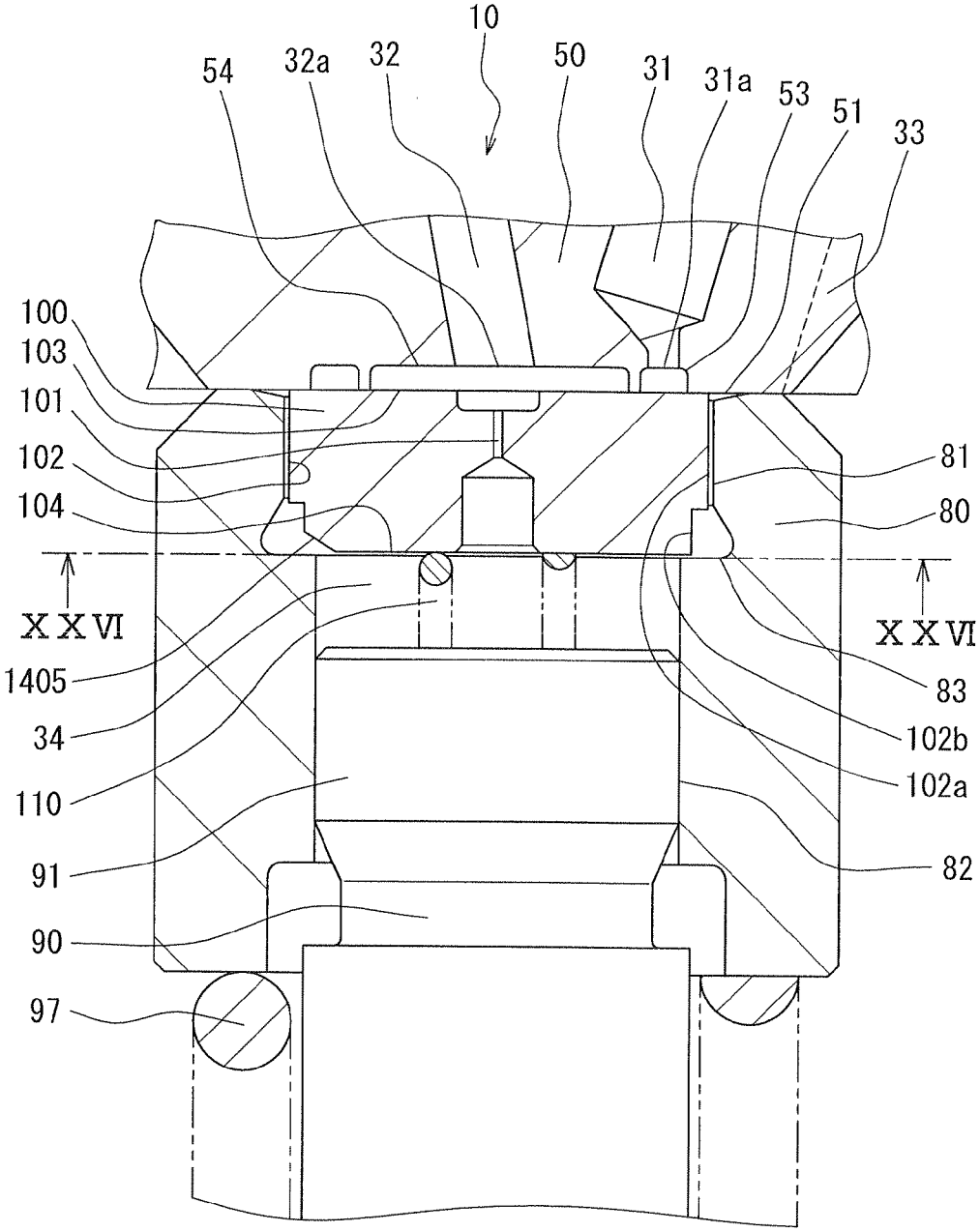
FIG. 25 is a partial enlarged sectional view illustrating a fuel injection device, taken along the section XXV-XXV of FIG. 26, in a 14th embodiment of the invention.
Figure 26:
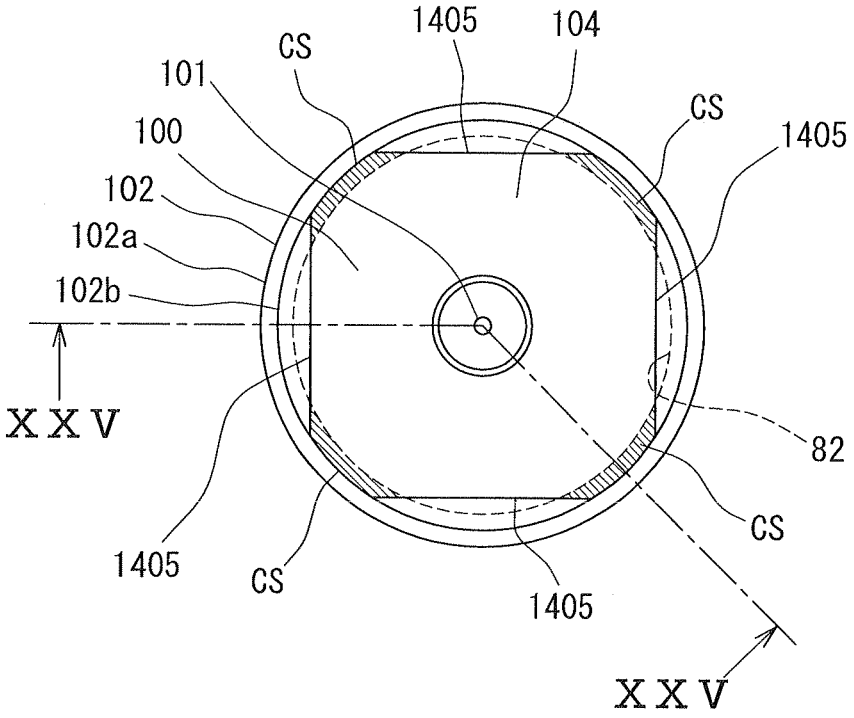
FIG. 26 is a partial sectional view illustrating the fuel injection device, taken along the section XXVI-XXVI of FIG. 25, in the 14th embodiment.

FIG. 25 is a partial enlarged sectional view illustrating a fuel injection device 10 in a 14th embodiment to which the invention is applied. FIG. 26 is a partial plan view illustrating the floating plate 100 of a fuel injection device 10 in the 14th embodiment.

In an above embodiment, at least one cutout portion 105 is formed in the floating plate 100. In an above embodiment, multiple cutout portions 105 are formed in the floating plate 100. In the description of an above embodiment, two cutout portions 105 so arranged as to sandwich the end face 104 are taken as an example of the multiple cutout portions 105. Instead, three or more cutout portions may be provided. In this embodiment, the floating plate 100 includes four cutout portions 1405 so arranged that the floating plate 100 is surrounded therewith, more specifically, the end face 104 is surrounded therewith.

In this embodiment, the floating plate 100 is formed in the shape of a stepped circular column having a large diameter portion and a small diameter portion. The outer circumferential surface 102 provides a large-diameter outer circumferential surface 102*a* and a small-diameter outer circumferential surface 102*b* smaller in diameter than the large-diameter outer circumferential surface 102*a*. An annular stepped surface is formed between the large-diameter outer circumferential surface 102*a* and the small-diameter outer circumferential surface 102*b*. The large-diameter outer circumferential surface 102*a* is opposed to the large-diameter inner circumferential surface 81 and can slide on the large-diameter inner circumferential surface 81. The diameter of the small-diameter outer circumferential surface 102*b* is larger than the small-diameter inner circumferential surface 82. The small-diameter outer circumferential surface 102*b* is positioned between the large-diameter outer circumferential surface 102*a* and the stepped surface 83. The small-diameter outer circumferential surface 102*b* surrounds the end face 104. The small-diameter outer circumferential surface 102*b* contributes to reduction of the outside diameter of the end face 104. The small-diameter outer circumferential surface 102*b* contributes to reduction of the outside diameter of the outer edge of the annular overlap range between the stepped surface 83 and the end face 104 in the radial direction.

In the floating plate 100, multiple cutout portions 1405 are formed. The cutout portions 1405 include four cutout portions 1405 so arranged as to surround the floating plate 100 from four directions. In the floating plate 100, two cutout portions 1405 parallel with each other are taken as one set and multiple sets of cutout portions 1405 are formed. The two cutout portions 1405 belonging to one set are extended in parallel with each other along the diameter of the floating plate 100. The cutout portions 1405 in one set and the cutout portions 1405 in the other set are extended in directions intersecting with each other, for example, directions orthogonal to each other. Two cutout portions 1405 adjoining to each other in the circumferential direction are extended in directions intersecting with each other, for example, directions orthogonal to each other. The cutout portions 1405 are dispersedly arranged at equal intervals along the direction of the circumference of the floating plate 100. Two cutout portions 1405 adjoining to each other in the circumferential direction are so arranged that the small-diameter outer circumferential surface 102*b* is partly left therebetween in the circumferential direction.

The cutout portions 1405 divide the annular overlap range between the stepped surface 83 and the end face 104 in the circumferential direction and thereby form multiple island portions CS away from one another. The island portions CS are dispersedly arranged along the direction of the circumference of the floating plate 100. The island portions CS are so arranged that they are away from one another by an equal distance along the direction of the circumference of the floating plate 100. Each island portion CS is extended in an arc shape. The outer edge of each island portion CS in the radial direction is defined by the small-diameter outer circumferential surface 102*b*. The inner edge of each island portion CS in the radial direction is defined by the small-diameter inner circumferential surface 82. Both edges of each island portion CS in the circumferential direction are defined by cutout portions 1405.

The cutout portions 1405 are formed only in the corner portion of the small diameter portion of the floating plate 100. Each cutout portion 1405 is so formed that it does not reach the large-diameter outer circumferential surface 102*a* but it reaches only the small-diameter outer circumferential surface 102*b*. Each cutout portion 1405 provides an inclined flat surface spread at an inclination from the central axis of the floating plate 100. Each cutout portion 1405 is provided by a chamfered portion formed in the corner portion between the small-diameter outer circumferential surface 102*b* and the end face 104. Therefore, each cutout portion 1405 is not only a groove portion but also referred to as chamfered portion. Each cutout portion 1405 is formed by chamfering to obliquely cut the corner portion. The four cutout portions 1405 are so formed that the cross-sectional shape of the tip of the small diameter portion of the floating plate 100 is partly trapezoidal. Each cutout portion 1405 forms an arc-shaped border line on the small-diameter outer circumferential surface 102*b* and further forms a linear border line on the end face 104.

As shown in the drawing, one cutout portion 1405 is defined by a curved line on the small-diameter outer circumferential surface 102*b* and a straight line on the end face 104. One cutout portion 1405 has a bow shape as viewed from the end face 104 side in the axial direction. One cutout portion 1405 is extended in parallel with one diameter of the floating plate 100 at a distance from the diameter. Both ends of each cutout portion 1405 in the direction of length (the direction of the bowstring) are positioned on the small-diameter outer circumferential surface 102*b*. As a result, the end face 104 is surrounded with the following bowstrings and curved lines alternately placed: four bowstrings provided by the four cutout portions 1405 and four curved lines provided by the small-diameter outer circumferential surface 102*b*.

The width of each cutout portion 1405 in the radial direction is so set that the cutout portion 1405 is extended to inside the small-diameter inner circumferential surface 82 in the radial direction. The width of each cutout portion 1405 in the radial direction is the width from a tangential line to the outer circumferential surface of the floating plate 100 parallel with the cutout portion 1405. The width of each cutout portion 1405 in the radial direction is smaller than the width of each cutout portion 105 in the radial direction in the above embodiments. The flow paths for letting the gap between the outer circumferential surface 102 and the large-diameter inner circumferential surface 81 and the pressure chamber 34 communicate with each other are dispersedly placed in the four cutout portions 1405. As a result, a required flow path cross-sectional area is ensured and yet multiple island portions CS are dispersedly arranged along the direction of the circumference of the floating plate 100.

In this embodiment, the stepped columnar floating plate 100 is adopted and thus the outside diameter of the contact surface portion can be reduced. As a result, the area of the contact surface portion can be reduced. In addition, the area of the contact surface portion can be reduced by the multiple cutout portions 1405. When the floating plate 100 is seated on the stepped surface 83 of the cylinder 80, flow paths for fuel can be formed by the cutout portions 1405. Since the cutout portions 1405 are provided by chamfered portions, excessive increase in the volume of fluid can be suppressed. The multiple cutout portions 1405 are dispersedly arranged at equal intervals in the circumferential direction and the multiple island portions CS are dispersedly formed at equal intervals in the circumferential direction. Therefore, the floating plate 100 can be stably seated. Since each of the island portions CS is formed in an arc shape, excessive wear is not caused.

Other Embodiments

Up to this point, description has been given to preferred embodiments of the invention. However, the invention is not limited to the above-mentioned embodiments at all and can be variously modified and embodied without departing from the subject matter of the invention. The structures of the above embodiments are just examples and the scope of the invention is not limited to the scope described in relation thereto. The scope of the invention is indicated by the description in the scope of claims and all the modifications are included therein within the meaning and scope equivalent to the description in the scope of claims.

For example, the grooves 106, 206, 306, 406, 584, 684, 907, 1085 may be formed of grooves having a triangular cross-sectional shape. Multiple small grooves may be provided both in the end face 104 of the floating plate 100 and in the stepped surface 83 of the cylinder 80. The grooves 106, 206, 306, 406, 584, 684 may be vertically and horizontally provided that they intersect with each other.

Each cutout portion 105 is formed as a groove by a plane spread along the direction of the axis of the floating plate 100 and a plane orthogonal to the axial direction. Instead, each cutout portion 105 may be formed by a chamfered portion like the cutout portions 1405.

The stepped columnar floating plate 100 described in relation to the 14th embodiment may be applied to an above embodiment and the cutout portions 105 may be formed in the small diameter portion.

Although the present disclosure has been fully described in connection with the preferred embodiments thereof with reference to the accompanying drawings, it is to be noted that various changes and modifications will become apparent to those skilled in the art. Such changes and modifications are to be understood as being within the scope of the present disclosure as defined by the appended claims.

What is claimed is:

1. A fuel injection device for an internal combustion engine, comprising:

a valve body having a passage for high-pressure fuel provided therein, and having a nozzle hole configured to inject the high-pressure fuel into a combustion chamber of the internal combustion engine at a tip of the valve body;

a valve member movable in the valve body in an axial direction of the valve body to interrupt and allow supply of the high-pressure fuel to the nozzle hole;

a housing member provided to face an end portion of the valve member, to define a pressure chamber for regulating a pressure of fuel acting on the valve member to control the movement of the valve member, the housing member having therein an inflow path for causing the high-pressure fuel to flow into the pressure chamber and an outflow path for causing the fuel to flow out of the pressure chamber;

a control member arranged in the pressure chamber and brought into or out of contact with the housing member, to interrupt and allow communication at least between the inflow path and the pressure chamber; and a cylinder housing the control member such that the control member is movable in the axial direction, the cylinder comprising: a large-diameter inner circumferential surface opposed to an outer circumferential surface of the control member; a small-diameter inner circumferential surface having an inside diameter smaller than an outside diameter of the outer circumferential surface of the control member; and a stepped surface provided between the large-diameter inner circumferential surface and the small-diameter inner circumferential surface and opposed to an end face of the control member on a side of the pressure chamber, wherein a plurality of grooves are provided in at least one of the end face of the control member and the stepped surface of the cylinder, to divide a contact surface portion between the end face and the stepped surface into a plurality of island portions.

2. The fuel injection device according to claim 1, wherein the grooves are provided in at least an area outside the small-diameter inner circumferential surface in a radial direction.

3. The fuel injection device according to claim 1, wherein the grooves include grooves causing a gap between the outer circumferential surface and the large-diameter inner circumferential surface to communicate with the pressure chamber.

4. The fuel injection device according to claim 3, wherein the grooves include a cutout portion that is provided in the control member to have a bow shape as viewed from the end face, and is open in the outer circumferential surface and the end face.

5. The fuel injection device according to claim 4, wherein the grooves include a plurality of the cutout portions.

6. The fuel injection device according to claim 5, wherein the grooves include two cutout portions extending in parallel with each other along a diameter of the control member.

7. The fuel injection device according to claim 5, wherein the grooves include a plurality of the cutout portions that are arranged to surround a periphery of the control member.

8. The fuel injection device according to claim 7, wherein the grooves include four cutout portions.

9. The fuel injection device according to claim 4, wherein each the cutout portion is a chamfered portion provided in the corner portion between the outer circumferential surface of the control member and the end face.

10. The fuel injection device according to claim 4, wherein the grooves further include thin grooves thinner than the cutout portion.

11. The fuel injection device according to claim 1, wherein the grooves include three or more grooves provided to divide the contact surface portion into three or more island portions.

12. The fuel injection device according to claim 1, wherein the grooves include grooves provided in the control member.

13. The fuel injection device according to claim 1, wherein the grooves include grooves provided in the cylinder.

14. The fuel injection device according to claim 1, wherein the outer circumferential surface includes a large-diameter outer circumferential surface opposed to the large-diameter inner circumferential surface, and a small-diameter outer circumferential surface positioned between the large-diameter outer circumferential surface and the stepped surface and surrounding the end face.

* * * * *